United States Patent [19]

Barnett

[11] 4,418,474

[45] Dec. 6, 1983

[54] PRECISION RESISTOR FABRICATION EMPLOYING TAPPED RESISTIVE ELEMENTS

[76] Inventor: William P. Barnett, 744 Pelleas La., San Jose, Calif. 95127

[21] Appl. No.: 162,963

[22] Filed: Jun. 25, 1980

Related U.S. Application Data

[63] Continuation-in-part of Ser. No. 114,144, Jan. 21, 1980, abandoned.

[51] Int. Cl.[3] ..... H01C 7/02

[52] U.S. Cl. ..... 29/612; 29/868; 29/869; 338/89; 338/195; 338/307

[58] Field of Search ..... 29/610, 612, 620, 868, 29/869; 338/89, 90, 121, 195, 307, 308

[56] References Cited

U.S. PATENT DOCUMENTS

| | | | |
|---|---|---|---|
| 3,213,402 | 10/1965 | Tassara | 338/260 |
| 3,405,381 | 10/1968 | Zandman | 338/254 |
| 3,441,804 | 4/1969 | Klemmer | 361/402 |
| 3,512,115 | 5/1970 | Solow | 338/285 |
| 3,541,491 | 11/1970 | Worster | 338/211 |
| 3,745,508 | 7/1973 | Bruder | 338/320 |
| 3,970,983 | 7/1976 | Hayasaka | 338/9 |
| 3,995,249 | 11/1976 | Ferry | 338/292 |
| 4,146,867 | 3/1979 | Blangeard | 338/195 |
| 4,172,249 | 10/1979 | Szwasc | 338/195 |
| 4,242,660 | 12/1980 | Cocca | 338/195 |

*Primary Examiner*—Leon Gilden

*Attorney, Agent, or Firm*—David Pressman

[57] ABSTRACT

Thin film resistors (FIG. 1) are produced on flexible tape 1 to provide at low cost a very wide range of precision resistors having low inductance. A reel of tape 70 coated with resistive material is etched to create a plurality of sinuous resistor patterns 3 and an array of spaced interconnection pads 102 suitable for connection to external leads via intermediate wires. Formation of a resistor of the desired precision value is performed by a selection of two pads, preferably by automated means by a trial and error technique. Prior to pad selection, the resistor can be covered with a material 4 which provides stability of resistance, mechnical protection and facilitation of assembly.

36 Claims, 19 Drawing Figures

PRECISION RESISTOR FABRICATION EMPLOYING TAPPED RESISTIVE ELEMENTS

This application is a continuation-in-part of Ser. No. 114,144, filed Jan. 21, 1980, now abandoned.

BACKGROUND—Field of Invention

This invention relates generally to electrical resistors and specifically to a method of producing, on flexible substrates, film resistors which can have any precise value, from a very high-valued resistance and/or voltage capability to a very low-valued resistance.

BACKGROUND—Description of Prior Art

Heretofore precision resistors for use in critical applications such as instrumentation, computers, and military electronics were wirewound because wirewound resistors have great stability and reliability. However, wirewound resistors are difficult to produce and even today they are commonly made by manual labor, which is expensive and fraught with human error. Many efforts have been made at automation, but the continued high price of such resistors testifies to the lack of success. Exemplary prior art attempts are found in U.S. Pat. Nos. 2,319,413 to Leathers et al. (5/1943), 2,639,864 to Hale (5/1953), 3,203,633 to Altieri (8/1965), and 3,458,929 to Gilbertson (8/1969).

Additional drawbacks of wirewound resistors are their relatively large size and their limited resistance range. A representative high stability precision wirewound resistor of 10 megohms has a relatively long length (3.8 cm.(1.5")) and a relatively large diameter (1.25 cm. (0.5")). Although special wirewound resistors are available, these require wires with extremely small diameters, e.g., 12.5 microns (0.5 mil). Since forty such wires are required to equal the cross-sectional area of one human hair, they are extremely fragile and therefore such resistors are very difficult to manufacture. Clearly therefore, there is a pressing need for smaller resistors made of easy-to-handle and more rugged materials.

Also the inherent inductance of standard wirewound resistors is unsatisfactory in many applications. While bi-filar winding techniques can reduce such inductance, this adds yet another complication to the task of making wirewound resistors.

Precision resistors have also been made of thin films. The thin film resistors of the prior art can be divided into two principal classes based on the technique used to adjust resistance value. Each has its own problems.

In the first class, resistance is adjusted by abrasion or by laser trimming. Many techniques have been devised to perfect such techniques. Exemplary prior art is found in U.S. Pat. Nos. 2,743,554 to Dailey et al. (5/1956), 3,512,115 to Solow (5/1970), and 4,159,461 to Kost et al. (6/1979). However, these patents do not deal with the problems that necessarily result from altering the physical state of some of the resistive material: some of the benefits of prior aging are lost, making it difficult to obtain precise stable values of resistance; also trimming has some effect on resistor characteristics, such as temperature coefficient of resistance (TCR) and noise level. The magnitude of these problems is related to the total resistance change required of trimming, which varies randomly from one resistor to the next. For this reason, aging after trim will alter these characteristics to an unpredictable extent. This contrasts with the desired situation where resistors are produced to predetermined tolerances and characteristics with no subsequent changes.

Film resistors can also exhibit inductance, especially when made on a cylindrical substrate and trimmed to form a spiral pattern. Exemplary prior art are U.S. Pat. Nos. 3,719,914 to Scharle (3/1073), and 3,858,147 to Caddock (12/1974).

In the second class, all resistance segments are initially shorted. Thereafter segments are selectively introduced into a series string by mechanically or otherwise removing the shorting element. While this eliminates the problem of physical alteration of the resistive elements, it introduces the new problem that no segment can be measured until the shorting element is permanently removed. Thus, individual variations between segments cannot be anticipated and are difficult to cope with. If a segment proves to be of higher resistance than expected, it is difficult to "back up" and start over. In principle, the segment could again be shorted by a separate operation, but this quickly becomes too difficult a procedure to be of practical value. Exemplary prior art is found in U.S. Pat. Nos. 2,758,256 to Eisler (8/1956), 3,441,804 to Klemmer (4/1956), 3,541,491, to Worster (11/1970), 3,638,162 to McWade (1/1972), and 4,146,867 to Blangeard et al. (3/1979).

Yet another problem common to thin film resistors arises when there is a mismatch between the coefficients of thermal expansion of the substrate and the resistive film.

Still another problem common to thin film resistors arises from the very fact that the resistive material is thin. Oxidation or other surface reactions have an effect on the resistance which is related to the percentage of the cross-sectional area which is oxidized. Not only is the effective cross-sectional area reduced by oxidation, but the materials' inherent resistivity, being dependent on the mean free path of electrons, in turn is affected by surface conditions. The result is that stability suffers as the film thickness is reduced. This relation between film thickness and stability is well known to those versed in the art. See E. R. Dean, "Aging in Thin Films", Proceedings of the Metallurgical Society of AIME, March, 1966.

Heretofore it has been difficult to overcome this problem as film resistors of the prior art do not provide a resistive path of sufficient length for both thick films and high resistance values. It is possible to buy film resistors using relatively thick metal films, and with an initially-shorted sinuous resistor pattern to avoid abrasive or laser trimming. These resistors have the advantages of low TCR, precision and stability, but only at great expense and with limited resistance range. For example, one such resistor of 200,000 ohms and 0.1% tolerance sells in small quantities for over $30.00. It is is a package 0.575 inche long. Resistance values from the same model are available to a maximum of 600,000 ohms in a package 1.12 inches long. This resistance is achieved by using more than one ceramic substrate with the film resistors on the substrates connected in series.

Because of these factors and in spite of very attractive catalog specifications, film resistors are not often used in those applications requiring great stability. One widely used digital voltmeter, for example, typifies common practice by using composition resistors where a ±5% tolerance is required, film resistors where a ±1% tolerance is required and wirewound resistors where a ±0.05% tolerance is required.

Special problems are encountered with very-high-valued resistors, e.g., of 1000 megohms and higher. These are typically made of such high resistivity materials as carbon and oxide films. Because of these materials, the resistors exhibit a large TCR, often have large voltage coefficients, and stability is poor. In addition, it is difficult to make accurate measurements of such high values of resistance, hence accuracy and final tolerance suffer.

Many of the problems encountered with very-high-valued resistors are also found with resistors intended for high voltage applications. In such cases, a long physical length is necessary. This has led to such solutions as packaging a string of individual resistors in series (see, e.g., U.S. Pat. No. 3,518,603 to Keprta et al., 6/1970) and packaging a string of flat ceramic substrates so their film resistors are connected in series (see, e.g., U.S. Pat. No. 3,813,631 to Matsuda et al., 5/1974). Such solutions are obviously quite bulky and expensive.

Special problems are also encountered when very-low-valued resistors, e.g., resistors having values below one ohm, are produced as precise resistance-value tolerances are difficult to achieve, and their temperature coefficient is poor.

The present invention substantially eliminates all of the above disadvantages. Specifically, the manual labor associated with production of wirewound resistors is eliminated, the physical size can be much smaller than that of wirewound resistors, inductance is essentially eliminated, and the resistance value can be much higher. No mechanical alteration of resistance material is required for precision adjustment and each segment can be measured before committing it to the resistor string. Expensive ceramic substrates are not required.

It is possible, for example, to utilize this invention to make 200,000 ohm/0.1% tolerance resistors with characteristics comparable to the $30.00 resistor previously referred to but at a far lower cost. It is believed that such a resistor made with the processes of this invention could be sold for less than $1.00.

Very high values of resistance can be produced without compromising temperature and voltage coefficients and stability, while measurement can be simplified by dividing the resistor into as many increments as desired. Very high voltages can be accommodated by using as long a length as needed, while avoiding unnecessary length because the voltage gradient is uniform. The resistor can be fabricated in a compact size where necessary, and high reliability and adaptability to automation are provided by the use of wirebonding techniques employed in the integrated circuit industry. Low material costs and automated measurement combine with this to provide very low manufacturing cost.

Very low values of resistance can also be produced, again with precise resistance value and without compromising TCR. Low material cost and adaptability to automated measurement are advantages here also.

OBJECTS

Accordingly, several objects of my invention are (1) the provision of a precision electrical resistor of high stability and reliability, low noise, and low inductance, (2) the provision of a resistor which can be produced at low cost and by automated means, (3) the provision of a precision resistor which can be packaged in a compact size, (4) the provision of a resistor which can be produced with very high resistance without compromise of TCR, voltage coefficient, stability, reliability, precision, or cost, (5) the provision of a resistor which can operate at very high voltages while exhibiting stability, low TCR, low voltage coefficient, and which can be produced with very high accuracy of resistance, (6) the provision of a resistor of very low resistance with no compromise of TCR or any other characteristic, (7) the provision of multiple resistors comprising the above advantages, and (8) the provision for adjustment of TCR at any predetermined temperature.

Further objects and advantages will become apparent from the ensuing description.

DRAWINGS

Figure 1:
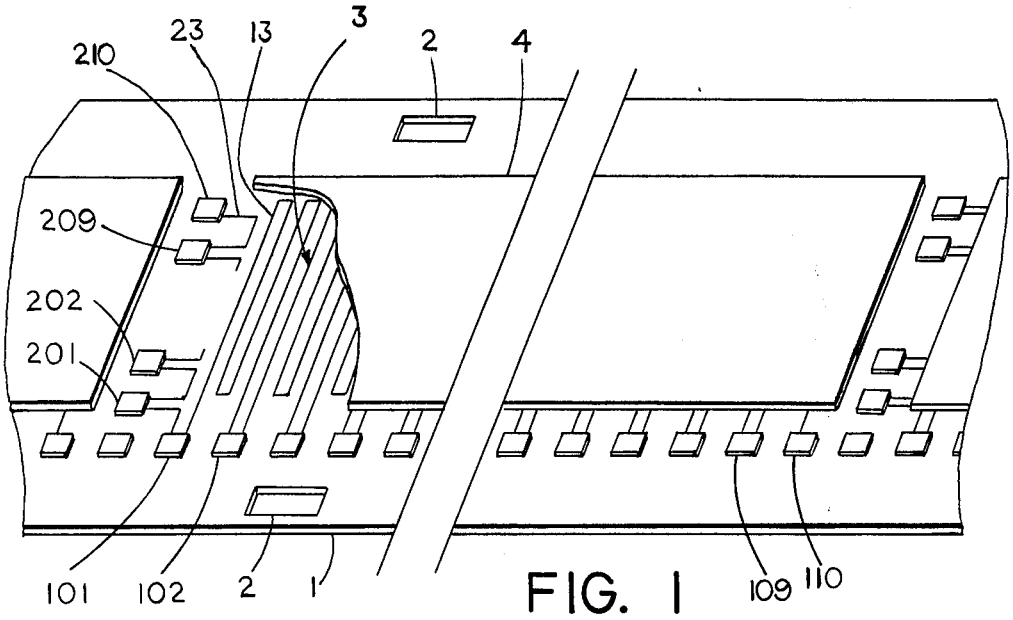
FIG. 1 is a perspective view of a resistor according to the invention, prior to testing and assembly.

REFERENCE NUMERALS 1 substrate
2 sprocket hole

-continued

| REFERENCE NUMERALS |
|---|
| 3 resistive element |
| 4 protective layer |
| 13 resistor segment |
| 23 resistor segment |
| 33 resistor segment |
| 40 outer horizontal probe |
| 41 inner horizontal probe |
| 42 inner vertical probe |
| 43 outer vertical probe |
| 50 horizontal controller |
| 51 vertical controller |
| 52 ohmmeter |
| 53 electrical lines |
| 54 computer interface |
| 55 computer interface |
| 57 control computer |
| 70 reel of tape |
| 71 reel holder |
| 72 sprocket wheel |
| 73 sprocket wheel |
| 74 reel |
| 75 work table |
| 77 motor |
| 80 motor |
| 81 constant tension mechanism |
| 82 sprocket wheel brake |
| 83 end of tape contact |
| 101 horizontal pad |
| 102 horizontal pad |
| 108 horizontal pad |
| 109 horizontal pad |
| 110 horizontal pad |
| 117 vertical bonding area |
| 124 large pad area |
| 127 sever line |
| 130 pad |
| 132 pad |
| 142 external lead |
| 144 common area |
| 152 horizontal pad |
| 153 bonding wire |
| 154 horizontal pad |
| 155 horizontal pad |
| 170 bonding wire |
| 171 terminating clip |
| 172 resistor segment |
| 173 bonding wire |
| 174 resistor segment |
| 175 bonding wire |
| 177 bonding area |
| 201 vertical pad |
| 202 vertical pad |
| 205 vertical pad |
| 206 vertical pad |
| 209 vertical pad |
| 210 vertical pad |
| 224 pad |
| 227 edge of tape |
| 231 cylindrical core |
| 232 pad |
| 234 pad |
| 237 edge of tape |
| 240 pad |
| 242 rolled tape |
| 245 sensing lead |
| 247 terminating lead |
| 250 molded package |
| 251 external lead |
| 252 external lead |
| 253 external lead |
| 254 raised portion |
| 255 bonding area |
| 257 potting compound |
| 270 bonding wire |
| 305 vertical pad |
| 306 vertical pad |
| 330 omitted segment |
| 331 parallel trimmed links |
| 333 resistor segment |
| 700, 701, 702, 703, 705, 707, 710, 711, 712, 713, 715, 717, |

-continued

| REFERENCE NUMERALS |
|---|
| 720 blocks in computer flow diagram |

FIG. 1—DISCRETE RESISTOR

FIG. 1 is a perspective view of a discrete resistor, prior to testing and packaging. The resistor includes a base layer or substrate 1 of a flexible, insulating material such as polyimide film, being, in one preferred embodiment about 0.025 mm. (0.001") thick, 2.5 cm. (1") wide, and 1500 m. (5000') long. Along this length are a plurality of patterned resistive elements 3. After measurement, substrate 1 is severed so the elements may be individually assembled. FIG. 1 shows one complete resistive element 3 and part of the adjacent left and right elements. Holes 2 along each side of substrate 1 provide means for a sprocket wheel to engage substrate 1 and move it when required.

Resistor element 3 is sinuous and is formed in segments 13 of a resistive material such as Nichrome metal or tantalum. Connected to the segments of element 3 at intervals along the length of substrate 1 are a horizontal row of contact taps or "pads" (termination areas) 101, 102, . . . 110. The pads are of a material such as gold or aluminum, which can be plated or otherwise deposited on resistive element 3 and which can be bondable to an external wire (not shown) using standard integrated circuit thermocompression or ultrasonic wirebonding techniques.

A vertical row of taps or pads 201, 202, . . . 210 of the same material as the horizontal pads are connected to resistive segments, such as 23. Resistive segments 23 each have a much smaller resistance value than each segment 13 of element 3, the relative values being such that all resistive segments 23 in series have slightly more resistance than one segment 13. All segments 13 and 23 are connected in series.

Element 3 is covered by a layer 4 of a flexible material of an insulating substance, such as FEP fluorocarbon resin, which is shown partially cutaway to expose part of 3. Layer 4 is bonded to substrate 1, thereby sealing resistive element 3 from ambient atmosphere, protecting it from mechanical damage, and providing a simple means to seal when it is wound upon itself or bonded to some other object such as a heat sink.

Formation of the film resistors and pads on substrate 1 is made by well known techniques presently in use in the production of flexible circuits for cameras, calculators and telephones, for example. Sheldahl Corp. (Northfield, Minn.), Rogers Corp. (Chandler, Ariz.) and GTI Corp. (Leesburg, Ind.), for example, presently manufacture such circuits.

To illustrate with an example, assume a 100,000 ohm resistor of great precision and stability is desired. Nichrome metal is a preferred resistive element because of its superior ability to resist oxidation and because of its low TCR. However, not even Nichrome is completely immune to oxidation, and in order to achieve the stability of wirewound resistors the Nichrome film must be much thicker than that generally used in metal film resistors of the prior art. A thickness of 1 micron (0.04 mil) is sufficient. Such a film has a sheet resistance of about 1 ohm/square; therefore a resistor pattern of 100,000 squares (i.e., an aspect or length-to-width ratio of 100,000 is required. Assuming resistive element 3 has a width of 50microns (2 mils), a length of 5 m. (200") is required. With a spacing between adjacent patterns of the resistive element 3 of 75 microns (3 mils) such a length requires overall dimensions of element 3 of 1.25 cm. (0.5") wide and 5 cm. (2") long. In order to allow for a manufacturing tolerance of ±20%, the overall length of element 3 is increased to 6 cm. (2.4"). Some additional length of substrate 1 is required to permit attachment to external leads during assembly.

Pads 101, . . . 110 and 201, . . . 210 are preferably 127 microns (5 mils) square, with a thickness of 1 micron (0.04 mil) of aluminum on top of a Nichrome pad of equal dimensions.

During assembly of a resistor, one horizontal pad is connected to one external lead by means of a wirebond, and one vertical pad is connected to one external lead by means of another wirebond. Means of making these connections are shown later and involve the use of a large area 124, a clip 171 (neither being shown in FIG. 1), or a combination of both.

The maximum available resistance (ignoring such techniques as laser trimming which are possible but not part of this embodiment) is that which will be obtained when all segments 13 and all segments 23 are in a series string. In the example given, the normal value would be 120,000 ohms plus 500 ohms, or 120,500 ohms. This series string is terminated at pads 110 and 210 but, as will be explained later, pads 110 and 210 are preferably used only to facilitate an accurate measurement of resistance; therefore pads 109 and 209 connect the greatest amount of resistance available in the assembled resistor.

The desired or "target" resistance will be obtained by starting with the maximum resistance, then eliminating enough of the horizontal segments 13 until the measured resistance is a rough value just above the target resistance. Then a fine adjustment to reach the target value is obtained by eliminating a sufficient number of vertical segments 23. Thus it is seen that the total resistance can be reduced until a value is reached that is equal to the target resistance ± one segment 23. A primary advantage of this invention is that the resistance of segment 23 can easily be made small enough to provide a resistance of very precise value. It is seen that to form a resistor of any desired value, measurements are made in order to identify one horizontal and one vertical pad for attachment of external leads.

FIG. 2—AUTOMATED MEASURING SYSTEM

Figure 2:
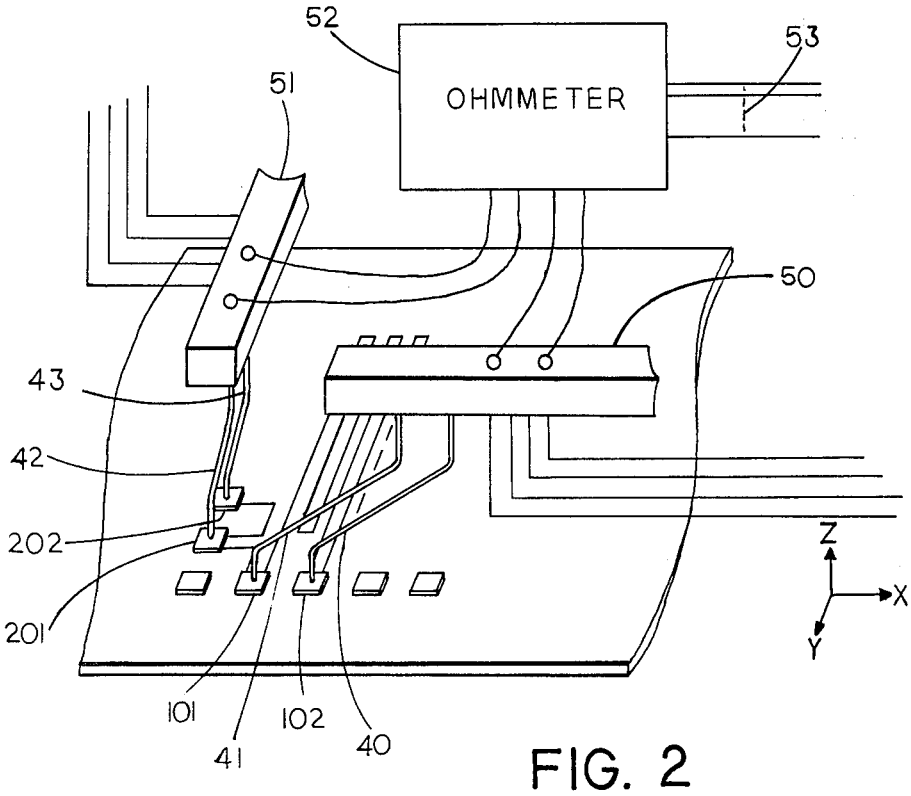
FIG. 2 is a perspective view showing a system for making resistor measurements, using a four-terminal technique.

FIG. 2 is a view of the resistor of FIG. 1 and automated measuring equipment for identifying the correct horizontal and vertical pads for forming a resistor of a desired value. Two horizontal probes 40 and 41, and two vertical probes 42 and 43 are placed in contact with the first two horizontal pads 101 and 102, and the first two vertical pads 201 and 202, respectively. These probes are connected via controllers 50 and 51 to ohmmeter 52. Measurements are made utilizing a standard four-terminal technique which avoids errors arising from contact resistance. Outer probes 40 and 43 force a controlled current through the resistance string between pads 102 and 202 while inner probes 41 and 42 sense the voltage across pads 101 and 201. Ohmmeter 52 automatically divides the voltage measured across pads 101 and 201 by the current sent through probes 40 and 43 to indicate the resistance in ohms on leads 53.

The physical position of the probes is controlled by controllers 50 and 51. Upon command from a control computer 57 (FIG. 3), these controllers raise the probes off the pads (in the Z direction), move them as desired in the X (or Y) direction and then lower them until contact is established with the desired pads. Probes 40 and 41 always move together, keeping the same relative position so as to contact two adjacent horizontal pads. So too, probes 42 and 43 always move together, keeping the same relative position so as always to contact two adjacent vertical pads. Movement of the horizontal probes occurs when the computer signals on the Z input of controller 50 to raise the probes, followed by a signal on the X input line to cause a predetermined movement in the X direction, as will be explained. A separate signal is used to cause the movement to occur in either the right or left direction. Another signal on the Z input then lowers the probes. The vertical probes move in response to similar signals on controller 51's Z and Y input lines, and its Y polarity line.

The controllers 50 and 51 use a solenoid working against a spring to effect Z movements, and a motor-driven screw drive to effect X or Y movements. Each probe has an individual micromanipulator to permit manual adjustment when required.

The probes are preferably made of tungsten wire tapered to a diameter of 25 microns (1 mil) at the end and are essentially flat on the bottom, thus utilizing practices common in the integrated circuit testing arts.

FIG. 3—AUTOMATED RESISTOR FORMATION SYSTEM

Figure 3:
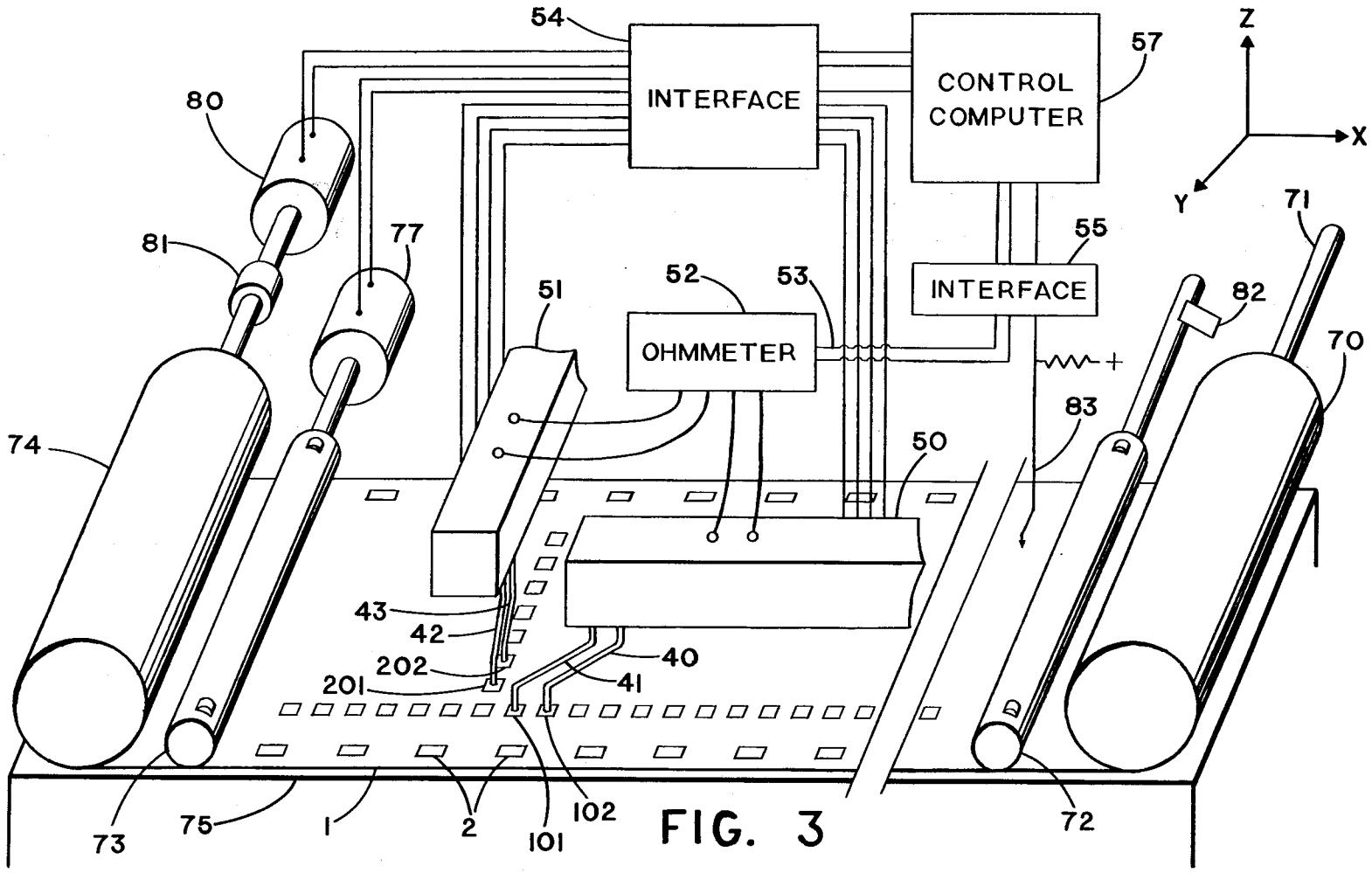
FIG. 3 is a diagrammatic view of an automated resistor testing and selection system.

FIG. 3 shows a perspective view of a reel 70 of tape 1 having a plurality of patterns as shown in FIG. 1. Reel 70 is loaded onto holder 71, and a length of the tape 1 is placed on test table 75 so that two sprocket wheels 72 and 73 engage holes 2 and hold the film flat and taut against table 75. The tape feeds laterlly across table 75 under control of motor 77 which drives sprocket wheel 73. The tape is then rewound onto a separate reel 74 which is driven by motor 80 via constant tension mechanism 81. In moving from reel 70 to reel 74, the tape makes one movement for each resistor pattern and remains stationary between movements while resistance measurements are made on each resistor. Except for manual beginning and end operations on the reel of tape, all operations are fully automated.

The first resistor to be measured must be placed so that its pads are accessible to the four test probes. the probes are then manually adjusted using the micromanipulators associated with controllers to contct the first two horizontal pads 101 and 102, and the first two vertical pads 201 and 202.

The first resistor must be identified by either manually making an identifying mark immediately before it, by manually punching a hole in tape 1, or by noting manually the length of tape from the starting end of the tape to the first resistor pattern.

Computer 57 is preferably of a desktop type, such as the Hewlett-Packard 98d25. The actual logic and sequencing are such that virtually any commercially-available computer will suffice. While it is also possible to construct all necessary control circuitry without using an actual computer, the 9825 is suggested in order to explain operations with complete clarity.

Computer 57 has a keyboard and an LED display (not shown) and will transfer data to and from a tape cartridge (not shown). A program can be entered into computer memory via the keyboard and then stored on a tape cartridge. Thereafter that program can be loaded directly into the computer memory from the tape cartridge. The 9825 computer also has the option of working via two commercially-available interfaces: a 16-Bit Parallel I/O card and a BCD (binary coded decimal) input card; these are provided in interface units 54 and 55 respectively.

The 16-Bit Parallel I/O card (in interface 54) provides interface outputs. It has sixteen separate output lines which have open-collector transistor drivers rated at 30 V. and 40 mA. Two of these lines are connected to the Z solenoids of controllers 50 and 51. Thus, raising and lowering the probes is achieved by programming the computer so that these output lines are in either the binary 37 1" or "0" state.

The X(or Y) movement of the probes is accomplished by operating the screw drive through a particular angular rotation corresponding to a particular linear distance. This is achieved by using stepping motors which can be stepped any number of times in predetermined angular increments. For example, the M series stepping motors (manufactured by the Superior Electric Co. of Bristol, Conn.) having stepping increments of 1.8 degrees or 0.9 degree, depending on the particular connections used, so that one complete revolution requires either 200 or 400 steps respectively. Driving the motor requires a series of electrical pulses, one step of the motor resulting from one pulse. Thus, either 200 or 400 pulses are required for one complete revolution of the motor. Computer generated pulses go from the computer I/O card to translator modules (also available from Superior Electric) which drive the motors in response to the pulses. The translator modules are capable of bidirectional operation of motors. Thus, with this hardware, movement of the probes a particular distance is achieved by sending a specific number of pulses from the computer to the translator. Generation by the computer of any specific number of pulses at one output terminal involves software procedures which are known and routinely used by those versed in the art.

Each of controllers 50 and 51 contains one translator, one motor, and one solenoid.

Motors 77 and 80 are driven by stepping motors in a similar manner, but with the need for greater control of the rates of acceleration and deceleration, as substrate 1 must not be overstressed. This is accomplished by the use of a buffered translater (not shown). These are also available from Superior Electric Co. The buffered translator accepts pulses at a fixed rate from the computer, stores the total, and then automatically adjusts the motor drive for suitable acceleration and deceleration. These buffered translators are also included in interface 54.

Interface 55 contains the BCD input card and accepts input signals which use logic levels of 0 and ±5 volts in a parallel BCD format. An ohmeter 52 is selected which will provide resistance readings in such form and is connected to computer 57 via interface 55. Thus, an ohmmeter which is auto-ranging and which provides a reading of six decimal digits would have six BCD outputs. This is handled by interface 55, which can accept up to 10 BCD digits, with overload and sign information. Operating in the auto-ranging mode, the ohmmeter makes a new measurement of resistance whenever the probes are moved to different pads. Since the ohmmeter requires a certain time interval to reach a stable reading after a change of resistance, the computer program allows a predetermined time from the moment it commands the probes to be lowered until it makes a comparison between the new resistance measurement and the appropriate limits. Optionally, time can be saved by controlling the ohmmeter range and by updating the ohmmeter reading on command from the computer. This can be done by connecting lines from the 16-Bit Parallel I/O card in interface 54 to ohmmeter 52.

FIG. 3, FIG. 4—SYSTEM OPERATION

Figure 4:
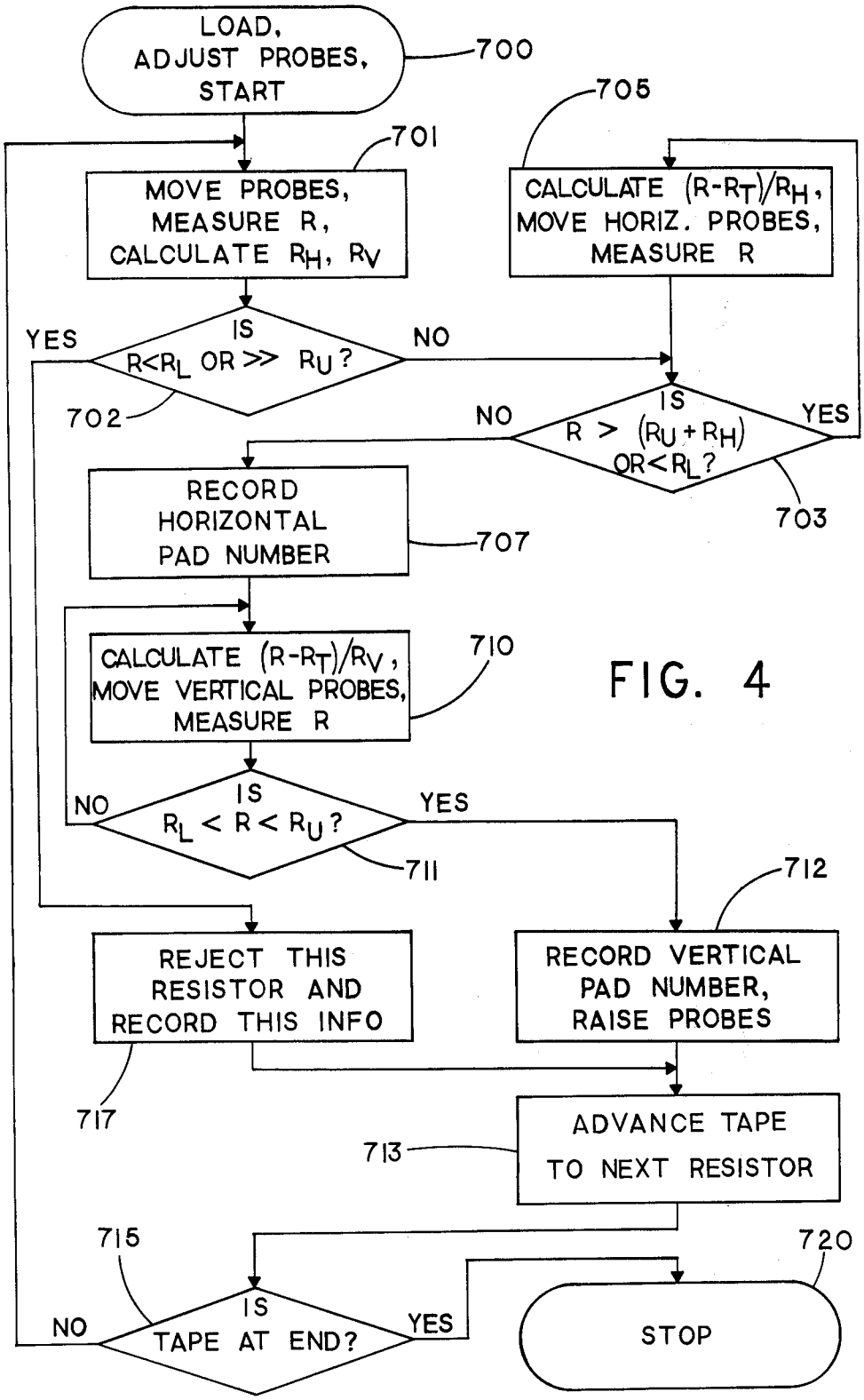
FIG. 4 is a computer flow diagram showing how the various operations are performed during measurement of resistance.

The automated system operation follows the sequence of operations shown in the flow chart of FIG. 4. After loading and probe adjustment are completed (block 700), control of the system is given to the computer.

The first automated operation is a command to lift probes 40–41 and 42–43 off pads 101–102 and 201–202 respectively, followed by a command for controllers 50 and 51 to move probes in the X and Y directions until they are positioned above the farthest horizontal pads 109 and 110, and above the farthest vertical pads 209 and 210. These distances are predetermined for a particular resistor and are programmed into the computer. In the example already given, the horizontal probes would be moved 6 cm. (2.4") and the vertical probes would be moved 1.25 cm. (0.5"). The probes are then lowered to establish contact with these pads (block 701).

After a timer interval the ohmmeter output reading is examined by the computers; this reading and the known of segments 13 are used to calculate R(H) (the average resistance of segments 13) and R(V) (the average resistance of segments 23).

In the present example, two hundred forty horizontal pads connect a total of two hundred thirty-nine segments 13 in series, while fifty vertical pads connect forty-nine segments 23 in series. All of the segments 23 in series have, as stated, slightly more resistance than one segment 13. Therefore, there are the equivalent of about two hundred forty segments 13 being measured. Their average value is equal to the measured resistance divided by 240. For a measured resistance of 107,511 ohms, therefore, segment 13 would average about 448 ohms. Segments 23 together would total about 448 ohms so their approximate average value would be 448 divided by 49 segments or 9.1 ohms. This information is stored in the computer for later use (block 701).

At this point the measured resistance is compared to two limits (block 702). The first limit is the lowest acceptable value of the resistor to be manufactured. For a 100,000 ohm resistor with a tolerance of 0.01%, this limit would be 99,990 ohms. A second limit, for quality control purposes, is established on the high side to prevent the use of material with faulty processing, such as a localized necking down of the resistive element 3 (block 702). If the measured value is outside these limits that resistor will be scrapped and that information will be stored on a computer tape together with the location of that resistor on tape 70 (block 717).

If the resistance is within limits (block 702) it is again compared to two limits; the low limit is the same as before while the high limit is equal to the sum of the upper acceptable limit of the resistor plus the value of one segment 13 (block 703). In the previous example, this would be 100,010 ohms plus 448 ohms or 100,458 ohms. When the value is no higher than 100,458 ohms, then that particular horizontal pad being used for measurement is to be used for termination since the measured resistance is now in a range where it can be adjusted to its final value by elimination of segments 23 from the series string. If the measured resistance is above the upper limit (the first time the flow reaches block 703 the resistance has already passed the lower limit) then a calculation is made to determine which horizontal pad to contact for the next measurement (block 705). This is done by determining the desired change in resistance and dividing it by the averaageresistance of segment 13. In the present example, this would be 100,000–107,511 or 7511 ohms divided by 448 ohms per pad or 16.7 pads.The computer would direct the controller to move the horizontal probes sixteen pads, the fractional pad being ignored.

Another measurement is then made (block 705). This measurement of resistance is again compared to the limits of block 703. It is possible because of random variations in resistance along the sinuous element 3 that the new value of resistance could now be too low, so the low limit of block 703 is not redundant. If the resistance value is still outside the limits, the computer again returns to block 705 and the probes are moved again, etc.

This process of successive approximations quickly locates a pad which connects to a resistance of value inside the limits of block 703, whereupon the horizontal pad then in contact with probe 41 is identified as the one to be used for termination. Its location is recorded on computer tape together with the location of that resistor on substrate tape 1 (block 707). This identification of the horizontal pad is made by recording its distance from either pad 101 or pad 109 (both distances being known to the computer) so that assembly equipment (directed by the computer tape in question) will direct a bonding capillary to the location of that horizontal pad.

It is now necessary to determine which particular vertical pad is connected to the horizontal pad already identified by resistance within the desired limits. The last measured resistance (for example, a value of 100,215 ohms) is compared to the target resistance (100,000 ohms in the previous example) and the difference is divided by the resistance of a single segment 23 to determine the required movement of the vertical probes. In the above example this would be 215 ohms divided by 9.1 ohms/segment, or 23.6 segments, so the vertical probes would be moved to the closest pad, which in the present case would be twenty-four pads away.

After moving the probes and allowing settling time for the ohm-meter, a new measurement is made (block 710) and compared with the final limits which the resistor must meet (block 711). If outside these limits, the computer returns to block 710. This process quickly converges on a vertical pad where the correct value of resistance is obtained (block 711) and the computer records this paticular vertical pad location on computer tape (block 712) together with the horizontal pad location already recorded at block 707.

Measurement of this resistor is now complete and the computer directs motor 77 to move the tape via sprocket 73. Motor 80 winds excess substrate tape 1 onto reel 74 via constant tension mechanism 81. Reel 70 unwinds as required and sprocket 72, which is rotated by the advance of tape 1, maintains slight tension in the tape via braking mechanism 82.

Before commencing measurement of the next resistor it is necessary to be sure that the tape 1 is not at the end (block 715). This is done by the computer which checks the voltage at contact 83. If the tape is not at the end, this voltage is +5 V. If the tape is at the end, contact 83 connects grounded table 75 and the voltage is zero (block 715). This information is conveyed to the computer via the BCD card in interface 55. When this check shows the tape is not at its end, the computer returns operation to block 701 to commence measurement of the next resistor. All probes at this time are typically at intermediate pad locations which are known to the computer. In order to repeat the quality control operation of block 702, all probes are moved to the outermost pads 109–110 and 209–210 to start the new measurement process.

Tape 1 will eventually come to the end, at which time the computer will stop operation (block 720). Tape 1 and reel 74 are then manually removed and kept together with the computer tape which contains the locations of those pads to be used during assembly.

Thus it is seen that, according to the invention, a resistor having a very high value can be fabricated to a very precise tolerance using automated means and without any of the aforementioned numerous disadvantages of prior art methods and resistors.

FIG. 5—HIGH RESISTANCE/VOLTAGE RESISTOR

Figure 5:
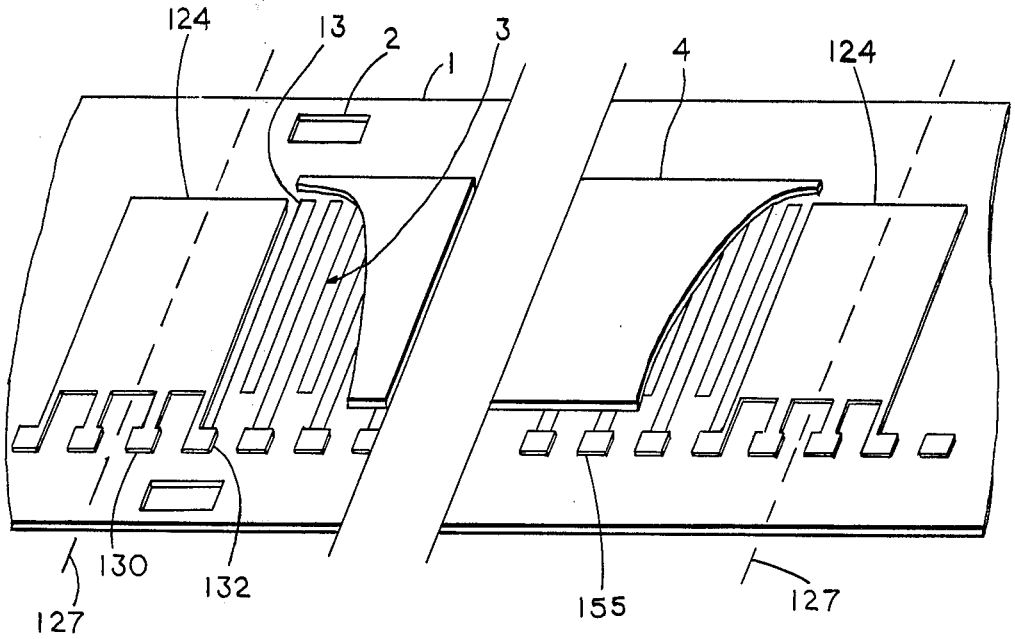
FIG. 5 is a perspective view of an embodiment used for making very-high-valued resistors and/or very-high-voltage resistors.

FIG. 5 shows an embodiment which provides a very high resistance and/or high voltage resistor. It consists of substrate 1 having a sinuous resistive element 3 deposited thereon, plus pads, such as 155, connected to the respective segments 13 of element 3. Relatively large conductive bonding areas 124 are also provided at intervals along the length of substrate tape 1, areas 124 being similar to pads 155 but much larger so as to permit attachment of external leads by soldering or other suitable bonding.

In this embodiment, a longer length of tape is used for each resistor than is ordinarily used in the embodiment of FIG. 1. This is done for three reasons: (1) to provide higher resistance, (2) to maintain a low voltage gradient (voltage per unit length of resistor) which is necessary to prevent breakdown at high voltages and (3) to make great precision possible without the requirement of vertical pads, as used in FIG. 1, by providing a larger number of horizontal pads 155.

As an example, assume a 200 megohm resistor is required which will be capable of operation at 200 kV. Assuming a maximum voltage gradient of 10,000 volts per inch to prevent voltage breakdown, a resistor length of 20 inches is required, with 10 megohms per linear inch of substrate tape 1. Such a resistor using the embodiment of FIG. 5 could use resistive element 3 about 12.5 microns (0.5 mil) wide and with a similar spacing. Thus there would be 1000 lateral lengths of element 3 per linear inch of substrate 1, so if each lateral length was 2.54 cm. (1") this would then mean the total length of element 3 would be 25.4 m. (1000") per linear inch of substrate tape 1. This would mean an aspect ratio of 2,000,000 squares. Such a resistor pattern would require a resistivity of 5 ohms/square to provide 10 megohms per linear inch of tape 1. A Nichrome resistance element of 0.2 micron (0.008 mil) thick would produce this resistivity.

Figure 12:
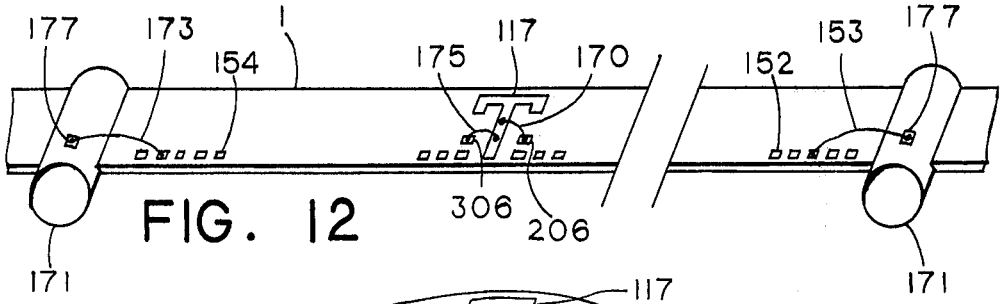
FIG. 12 is a perspective view of a tapped resistor with a second means of attaching external leads.

Bonding areas 124 serve dual purposes. They identify the beginning of a resistor as well as providing a means of attaching an external lead (although the latter function can be provided by other means as shown in FIG. 12). Dashed lines 127 indicate where the tape is severed during assembly, thus ending one resistor and beginning another.

For those applications requiring both precision and high resistance, adjustment to the recise resistance value is accomplished by bonding a wire from some particular pad 155 to an area 124 (the wire can also be bonded to intervening pads to prevent excessive movement during assembly).

A computer flow chart describing the selection of this pad would be similar to that of FIG. 4, but simplified. First, since there are no vertical pads or probes, block 701 (FIG. 4) starts with one pair of probes (the "left" probes) contacting pads 130 and 132 while the other pair of probes (the "right" probes) is free to move along the length of tape and contact other pads as desired. The right probes are directed to move to some predetermined pads connected to a resistance whose value approximates either the target resistance or the maximum range of the ohmmeter, whichever is smaller. The design value of resistance is used in the first selection of these pads. A resistance measurement is made and the resistance per segment 13 is calculated and used thereafter in place of the design value. Both the lower and upper limits of block 702 are determined by quality control considerations, extremely low or high resistance values being cause for rejection (block 717).

Assuming a reasonable value, the flow goes to block 703 where the limits are now those of the completed resistor. For example, if a 200 megohm ±0.1% resistor is required, the limits of block 703 would be 199.8 and 200.2 megohms. Assuming a first measurement of about 10 megohms (limited by the range of the ohmmeter) the computer flow goes to block 705 where the calculated difference between target and actual resistance would be about 190 megohms.

As this is again beyond the range of the ohmmeter, a second measurement is required at a second intermediate point, taking account now of the actual resistance per segment 13. To make this second measurement both the right probes and the left probes are moved so as to make a measurement of those segments 13 immediately to the right of the elements included in the first resistance measurement. The second measurement is added to the first and total is compared to the target value (block 705). In this example, it would take about 19 separate measurements to reach the 190 megohm range.

At this point, a 20th measurement is made; if the total of all 20 measurements is equal to or greater than the lower limit of 199.8 megohms, then subsequent measurements involve movement of the right probes only, making as many movements and measurements as required to locate that particular pad 155 which would encompass the correct resistance. With 100 pads per linear inch of tape 1, the resistor in the example could be adjusted in increments of 0.1 megohm or 0.05% of the total.

If the 19th measurement reached a total of less than the lower limit, then a 20th step involving movement of both probes is required, such steps continuing until a resistance value equal to or exceeding the lower limit is reached, followed by measurements moving the right probes only. When pad 155 is identified it is recorded on a computer tape together with the location of that particular resistor (block 707).

Blocks 710, 711 and 712 of FIG. 4 are also omitted and the computer proceeds directly to block 713. The operation repeats until the tape is at the end.

For applications requiring very high voltages but not requiring high precision, the tapped connections (pads) are omitted. In such a case an area 124 would be used at the beginning and end but no intermediate bonded wires would be required. Intermediate bonding areas 124 are included if one or more intermediate external connections is required.

Assembly of the resistor involves lead attachment to both the left and right areas 124. The tape 1 is severed along lines 127. Tape 1 is then coiled for packaging using injection molding, an epoxy filled case or other means, or it is molded into a straight line, or otherwise, as required.

FIG. 6—RESISTOR WITH REDUCED LENGTH-TOLERANCE PRODUCT AND INCREASED PRECISION

Figure 6:
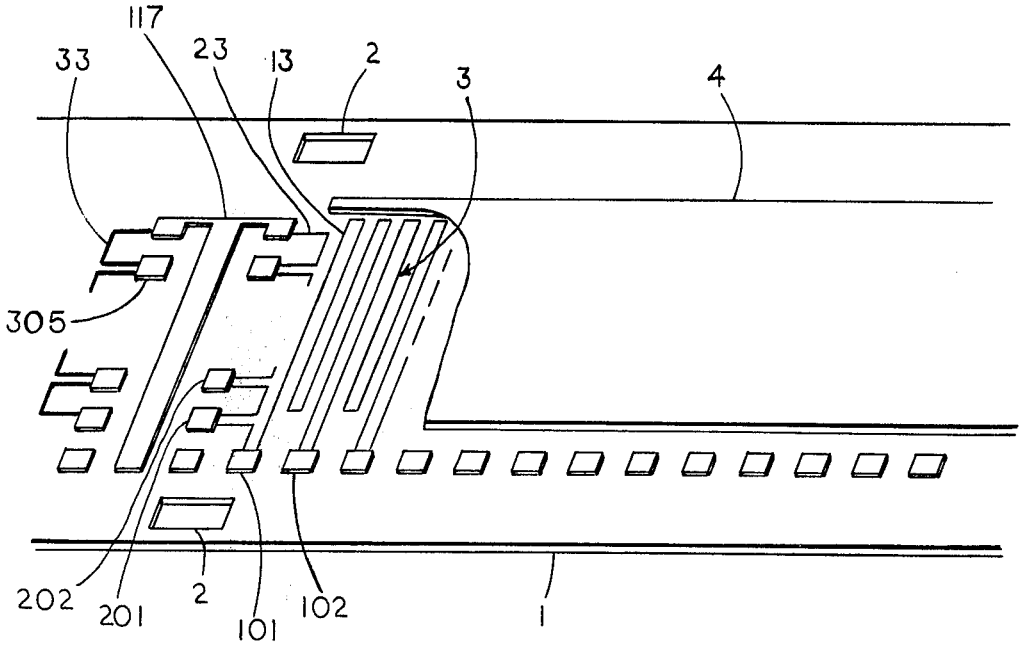
FIG. 6 is a perspective view of an embodiment which is a variation of that of FIG. 1 and which facilitates the production of moderately low values of resistance of precise values, or in which the length-tolerance product is reduced.

FIG. 6 is a variation of FIG. 1 with the same substrate 1, resistive element 3 and holes 2, with resistor segments 13 and 23 connected to pads as before. FIG. 6 differs in having a second set of vertical pads 305 connecting a second string of resistor segments 33, all segments 13, 23 and 33 being connected in series. FIG. 6 also has a vertical bonding area 117 which is not present in FIG. 1.

During assembly, one wirebond is made from a primary vertical pad such as 202 to the ares 117, thus altering the number of resistor segments 23 in the series string. A second wirebond connects a secondary pad 305 to an external lead, thus altering the number of resistive segments 33 in the series string as well as providing an external connection.

The purpose of the additional segments 33 is to provide greater resolution of resistance value. This is useful in three cases: when the desired resistance value is low (i.e., 1000 ohms) and the number of resistive elements 13 is too few to achieve sufficient precision with the embodiment of FIG. 1, when it is necessary to provide a precision resistor in a package of short length, and when it is necessary to provide a resistor with ultra precision in a package of the same length.

To illustrate the first case, assume a resistor of 1000 ohms ±0.01% is required. If the main resistor segments 13 are one hundred ohms each and there are 100 vertical resistor segments 23 of one ohm each, then the embodiment of FIG. 1 permits an adjustment to within one ohm or a tolerance of ±0.1%. Greater resolution could be achieved by increasing the length of tape 1 so as to include a greater number of segments 13 of lesser individual resistance (segments 23 also being of lesser resistance) but this would be an inefficient use of substrate area. More efficient use is made possible by adding a second set of vertical resistor segments 33 which permit adjustment of the resistance in increments of 0.1 ohm. This involves an extra wirebond but the added cost is more than offset by the saving of substrate tape 1.

In the second case, where the tolerance is readily achieved with the embodiment of FIG. 1, the number of vertical pads 202, etc. may be reduced by including a second set of vertical pads. For example, if 100 vertical pads had been used, two sets of 10 vertical pads would provide the same resolution and would greatly reduce the package length.

In the third case, where ultra-precision is required, the use of a second set of vertical pads and resistor segments greatly increases the precision already attainable. For example, by adding such vertical pads to the 100,000 ohm/0.01% resistor used to illustrate FIG. 1, the resolution can be increase to 0.0001%.

The procedure for measuring the resistor of FIG. 6 involves the identification of three rather than two bonding pads. The first step, a measurement of the total resistance of all segments 13 and 23, and the second step, identification of the horizontal terminating pad, proceed exactly as shown in FIG. 4 in steps 700 through 707. In the third step, identification of the correct vertical pad such as 202, is identical to the procedure for identifying the vertical pad of FIG. 1. This is shown in blocks 710 through 712 in FIG. 4.

The fourth step, identification of the pad connected to small resistor segments 33 is different from the third step only in that the target value must be adjusted to allow for those segments 23 which will be shorted by a wirebond after assembly. Moving the probes from the intermediate vertical pads (202, etc.) to pads such as 305 will reintroduce all intermediate resistor segments 23 into the resistance being measured. This problem is handled as follows. The measured resistance when contacting that intermediate pad (such as 202) which is to be used for bonding is stored in the computer memory. The probes are then moved to the vertical bonding area 117 and a new measurement is made of the resistance. The difference between these two measurements is added to the target resistance, as it is precisely the amount of resistance which will be eliminated when a wire is bonded from the intermediate vertical pad 202 to the bondng area 117. Identification of the last pad for bonding then proceeds as in the third step above. It involves a computer flow involving blocks 710, 711, and 712 with the difference being that the limits have been altered as described above, and the vertical probes are in contact with pads 305 etc.

Figure 7:
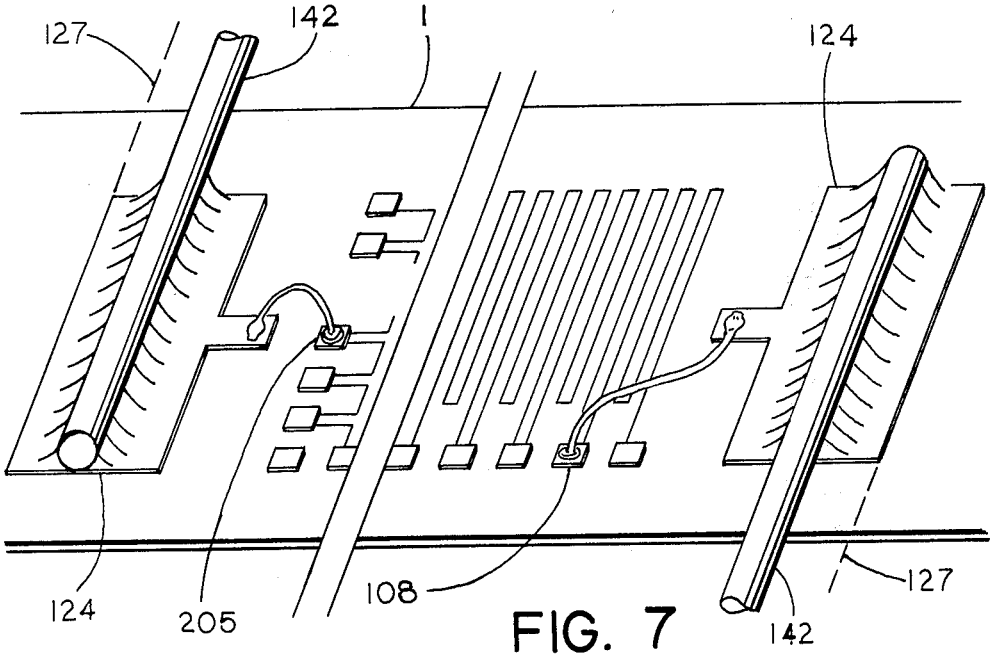
FIG. 7 is a perspective view illustrating one means of attaching external leads.
Figure 8:
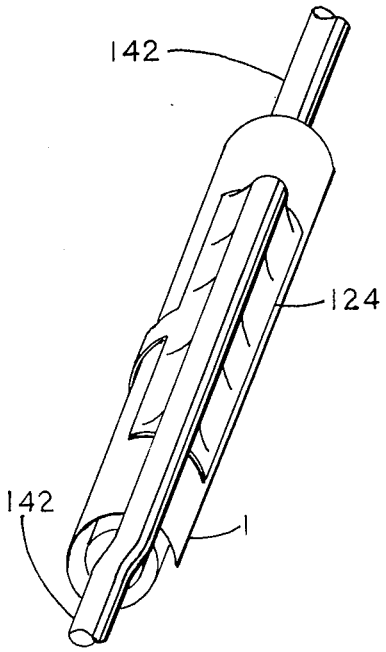
FIG. 8 shows the resistor of FIG. 7 after it is formed into a cylindrical shape.
Figure 9:
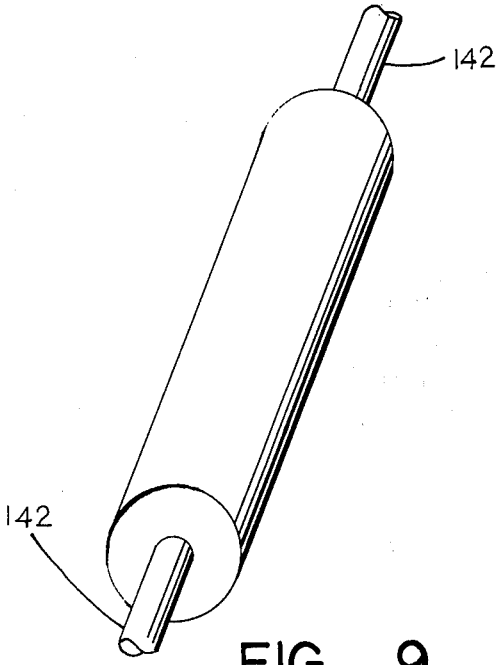
FIG. 9 is a perspective view of FIG. 7 and FIG. 8 after the resistor has been molded.

FIGS. 7, 8 and 9—PACKAGE ASSEMBLY

FIGS. 7, 8 and 9 show one technique for packaging the embodiments of FIG. 1 and related embodiments utilizing the two bonding areas 124. Areas 124 are provided on the surface of the tape at the same time the pads are made and are suitable for both wirebonding the soldering or otherwise connecting to external leads.

Connections from the selected resistor pads such as 205 and 108 to bonding areas 124 are done by standard wirebond techniques, either thermocompression or ultrasonic bonding. Attachment using conductive adhesives is also possible.

The pads to be used, 205 and 108, are known from the measurement process and this information is now available, stored on a computer tape. For manual wirebonding, this information can be presented in a form as simple as two numbers which identify the two pads, which the operator would locate by counting. Alternatively, substrate 1 could have pad identifying numbers printed thereon at the same time the pads are formed. An intermediate level of automation would move the resistor tape automatically until the correct pad was located under the wirebonding capillary. With complete automation, the bonding itself would also be done without an operator. Each of these techniques is already known in the integrated circuit industry for attaching leads to pads of an integrated circuit chip and carrier.

The tape is severed along lines 127 before or after external lead attachment. Attachment of external leads 142 to bonding area 124 is done by the use of solder, conductive adhesive, etc. Thereafter substrate 1 is rolled into a cylinder; FIG. 8 shows the resistor after such rolling. FIG. 9 shows the completed resistor after molding.

FIG. 10—TAPPED RESISTOR

Figure 10:
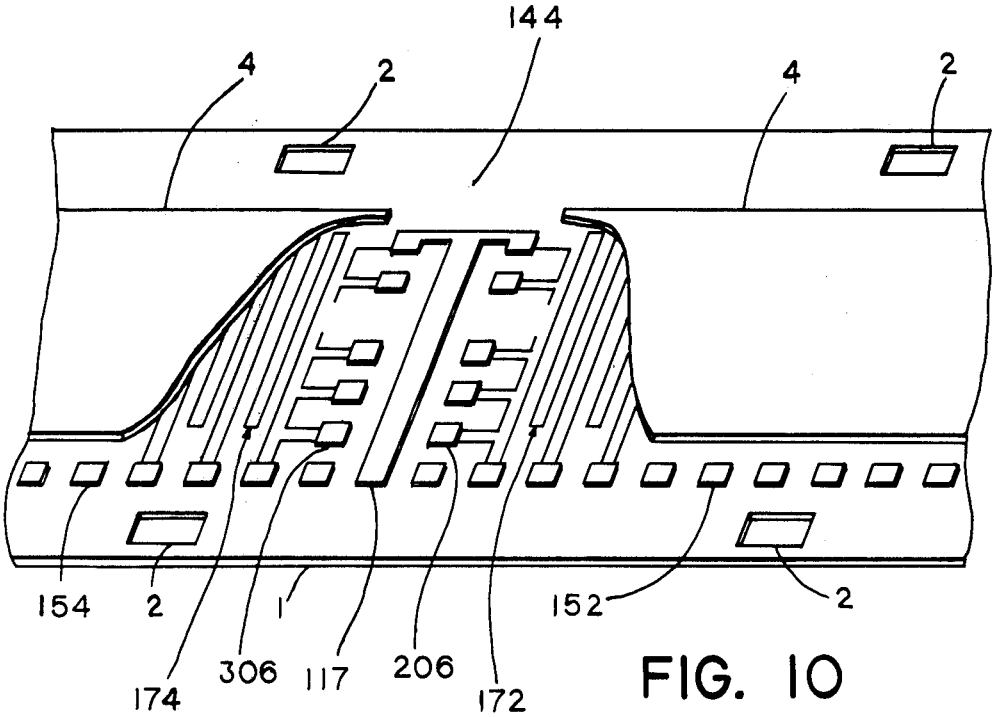
FIG. 10 is a perspective view of a tapped resistor.

FIG. 10 shows how the technique of the invention may be used to form a precision voltage divider or precision-tapped resistor. In FIG. 10, area 144 is where two resistors are connected together to form the common connection, or tap. The outside ends of the two resistors are not shown, being somewhere to the left and to the right of the portion of resistor tape illustrated.

Measurement and assembly can be done either in a manner which will provide a precise resistance ratio without the same precision of actual resistance values, or so that both the magnitudes of the actual resistances and their ratios are precise. The latter is accomplished by simply making two precision resistors of the correct magnitudes; this will be sufficient to provide the desired precision resistance ratio.

Consider first those horizontal pads, such as 152, and vertical pads, such as 206, to the right side of vertical bonding area 117. Note that they are identical to the resistor and pads of FIG. 1. Measurement and pad identification proceed in the same way as as described for FIG. 1.

That part of FIG. 10 to the left side of vertical bonding area 117 constitutes a mirror image of the right side of FIG. 10, and thus constitutes a second resistor which is connected to the resistor on the right side by bonding area 117. By making a second measurement and pad identification process on this left side resistor, a second pair of pads is identified for wirebonding during assembly. The combination makes two precise resistors of two desired values and which are interconnected by a tap so as to provide, in effect, one resistor with a precisely determined tap.

The computer flow chart of FIG. 4 is unchanged for measuring the right side resistor. Extra blocks (representing extra sequencing steps) are added between 712 and 713, going to a new block 2701 after measurement of the right side resistor is complete. Block 2701 is a modification of block 701 and moves probes to contact such horizontal pads as 154 and such vertical pads as 306. A complete new sequence is followed, using blocks 2701, 2702, 2703, etc. which duplicate blocks 701, 702, 703, etc. except for resistance values which are altered for the requirements of the left side resistor. Blocks 2707 and 2712 record the left side pads to be used for wirebonding. After completing these blocks, the computer goes to block 713 as in previous examples.

Construction of a tapped resistor where only the ratio of resistance is important is a simpler task. In this case it is sufficient to identify a horizontal bonding pad on, say, the right side resistor which has the desired resistance between it and bonding area 117. This is quite simple to do as the resistance tolerance would be quite loose, such as $\pm 5\%$. This can be accomplished by horizontal pad selection only, ignoring vertical pads 206 and measuring directly from vertical bonding area 117 to the horizontal probes. This minimizes measurements as well as eliminating one wirebond (170, FIG. 12). The second resistor (in this case to the left of the bonding area 117) is then adjusted to a value which is the desired multiple of the value of the first resistor. In this case, computer flow blocks 710, 711, and 712 are omitted, other blocks remaining the same as described for the above tapped resistor.

A basic advantage of trimming to a precise value as well as ratio is that several sets of such tapped resistors can then be used in an R/2R network. This is especially attractive if all of the resistors are made from a common tape so that uniformity of material characteristics is maintained. Discrete resistors of the prior art typically require expensive sorting to obtain the same resistance magnitudes and temperature coefficients, thus preventing their wide usage. The tapped resistors described above require no such sorting, thus making it economically possible to use them in R/2R networks which are widely used in digital to analog converters, for example.

FIG. 11—TAPPED RESISTOR

Figure 11:
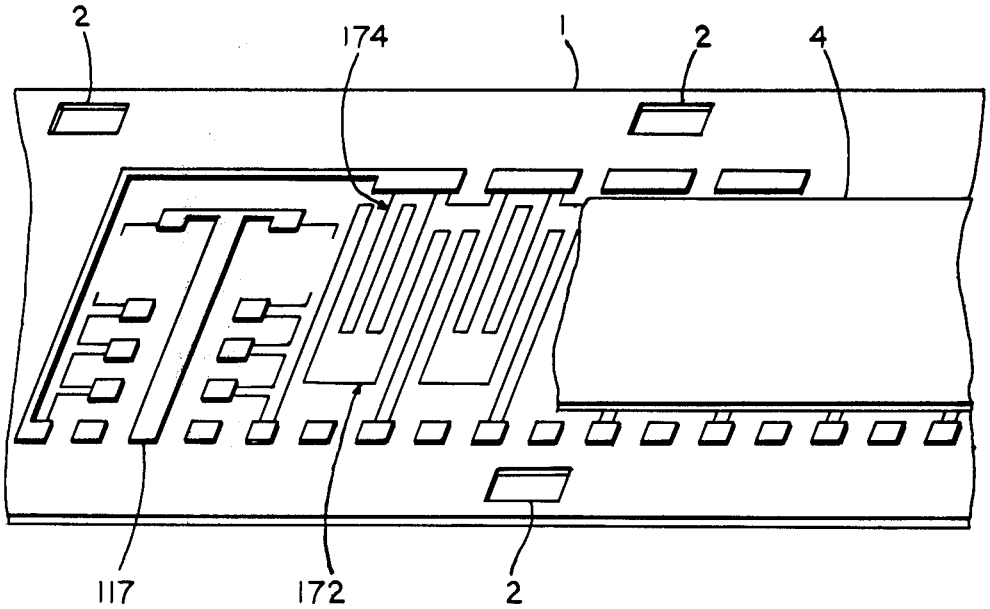
FIG. 11 is a perspective view of a different embodiment of FIG. 10.

The embodiment of FIG. 11 is a variation of that of FIG. 10 and insures that the resistance ratio will maintain the best possible stability as a function of temperature. The left resistor pattern 174 is effectively "folded over" and interdigitated with the right side resistor pattern 172. In this way both resistors are held at the same temperature so that their resistance ratio is maintained at the highest level of precision under all load and ambient conditions. The beginning and end terminations are made to the same end of the tape while the tap is made at the other end. Also, the arrangement of pads is different, requiring a modification of the probing procedure. It is a simple variation of the procedures already described and involves nothing more than dimensional changes from what has been previously described.

FIG. 12—TAPPED RESISTOR ASSEMBLY

FIG. 12 illustrates one precedure by which a tapped resistor may be assembled. It shows a method of connecting the two ends which may also be used in assembling a single resistor in lieu of the soldered-lead method shown in FIG. 7, by omitting the center lead and the connection to area 117.

In FIG. 12 substrate 1, pads 152, 154, 206 and 306 and vertical bonding area 117 are as described before. The resistor segments are not shown, while the edges of substrate 1 (includng holes 2) are severed before assembly to reduce the size of the assembled resistor.

Two cylindrical clips 171 are provided; these have slots into which the tape 1 can be fitted. Tape 1 is rigidly affixed to the clips, preferably by adhesives, but mechanical indentation of the inner surfaces of the slots or a screw which tightens the clip against the substrate can also be used. Areas 124 (not shown) can be included on tape 1 and reflow soldered to the clips, where solder is acceptable. Included on each clip is an area 177 of material suitable for wire attachment by either thermocompression or ultrasonic wirebonding, or by use of conductive adhesives. Areas 177 are connected internally to the ends of clips 171. After the clips are connected mechanically to the substrate, electrical connection is made to the two ends of the resistors by wires 153 and 173 bonded from the appropriate pads on the substrate to areas 177 on the clips. Vertical bonding area 117 also is connected by two wires 170 and 175 to the appropriate vertical pads at this time. As before, identifications of the correct terminating pads is available from information stored at the time of resistance measurement.

FIGS. 13, 14, 15—TORAH PACKAGING

Figure 13:
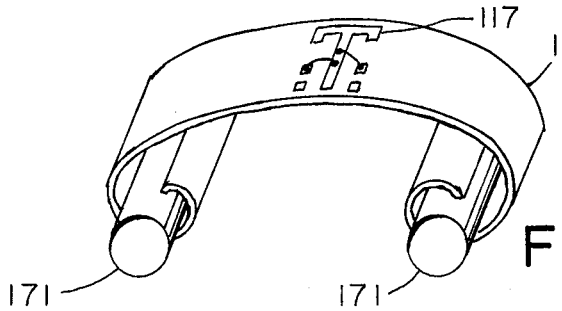
FIG. 13 is a perspective view of the resistor of FIG. 12 with both ends rolled into the form of a torah.

Material of substrate 1 which extends beyond the clips is severed and the clips are then both rotated toward each other, resulting in the "torah" arrangement shown in FIG. 13. Vertical bonding area 117 need not be located exactly halfway along the substrate as the clips are rotated individually as required so vertical bonding area 117 is always exposed.

Figure 14:
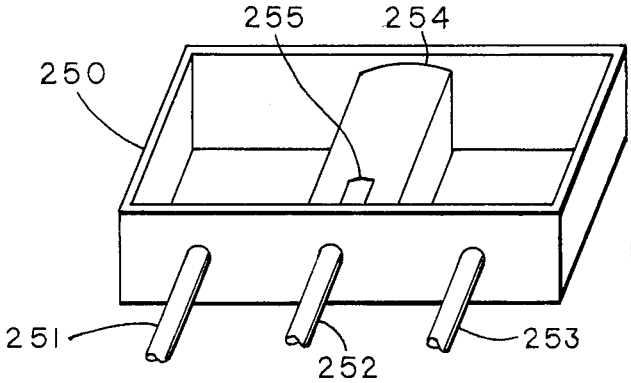
FIG. 14 is a perspective view of a molded package to be used with the resistor of FIG. 13.
Figure 15:
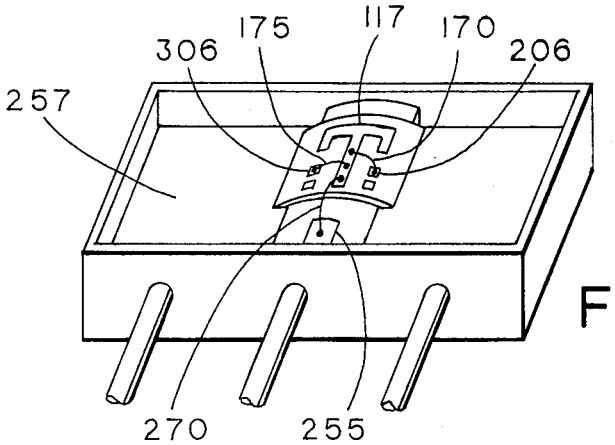
FIG. 15 is a perspective view of a tapped resistor after assembly in the package of FIG. 14.

In FIG. 14 a package 250 is shown which is preferably made of molded plastic, with external leads 251, 252, and 253 and an internal raised area 254 with plated area 255 which is connected electrically to the middle lead 252. The torah-shaped assembly of FIG. 13 is placed in the cavities of the package of FIG. 14, being positioned by the constraints of the package dimensions so that bottom ends of clips 171 press against those parts of leads 251 and 253 which are exposed on the inside of package 250. Permanent connection between the clips and leads can be made by reflow soldering, for example, preferably using a high temprature solder to permit later insertion of the resistor into a printed circuit board which will be subjected to wave soldering. In this way the temperatures to which the resistor is subjected to during wave soldering are insufficient to remelt the internal solder.

Other means of making a permanent connection between the clips 171 and the leads 251 and 253 include conductive epoxies, the only constraint being that they must not introduce any significant electrical resistance and that they must be stable mechanically and electrically during the expected life of the resistor.

The mold is now filled with a potting compound 257 which covers most of the substrate, leaving exposed a small length which includes vertical bonding area 117. At this time, the vertical bonding area is connected to plated area 255 by use of another bonding wire 270, thus completing all electrical connections to the resistor. If desired, vertical bonding area 117 can be made large enough to permit connection to area 255 by a soldered wire. With further potting to cover the bonding area and the bonding wire (optional), and sealing the package, assembly is complete.

In those cases requiring the most extreme precision of resistance, selection of the vertical terminating pads 206 and 306 may be made after potting and a suitable stabilizing operation. In this case, wirebonding from vertical bonding area 117 to the two vertical pads 206 and 306 is done at the same time that the vertical bonding area is connected by wirebond 270 to the plated area 255.

The same procedure of measuring and connecting the vertical pad after potting may also be used with single resistors such as those of FIG. 1. In such a case, using the assembly of FIGS. 12, 13, 14 and 15, substrate 1 is wound primarily on one clip 171 so as to leave the vertical pads 201, 202 exposed after potting in package 250. In this case the middle lead 252 is eliminated and the plated area 255 is connected to one of the outer leads. After insertion of the torah-shaped assembly into the package, connecting the clips to the leads, and potting and subjecting the entire assembly to a suitable aging and stabilizing operation, the correct vertical pad is identified by measurement of resistance and is then connected to the plated area 255 by wirebonding. Again this procedure would be reserved for those situations requiring the ultimate in precision of resistance.

FIG. 16—VERY-LOW-VALUED RESISTOR

Figure 16:
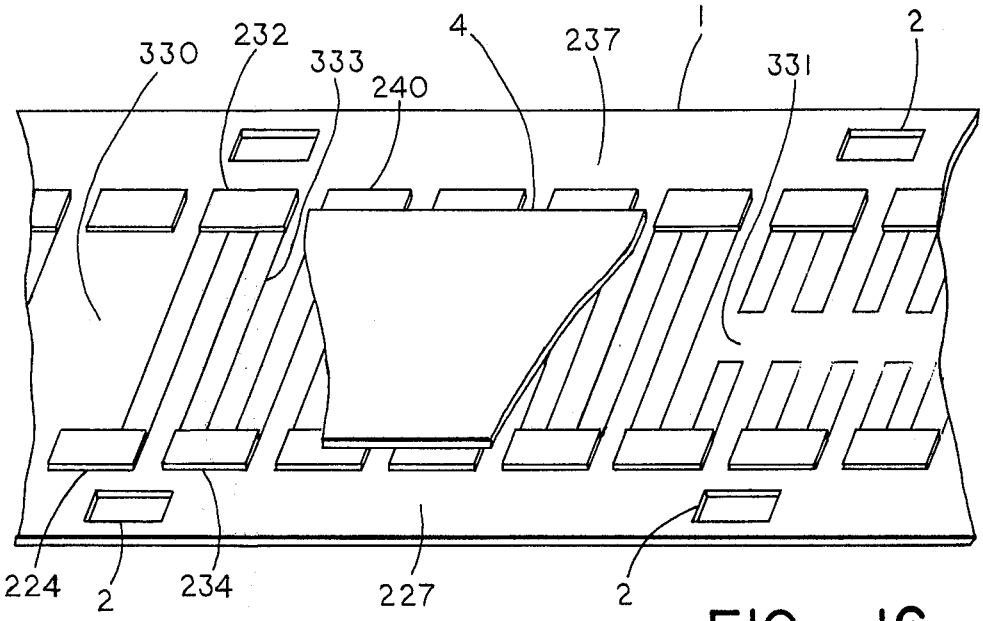
FIG. 16 is a perspective view of a low-valued resistance.

FIG. 16 shows an embodiment for production of very low values of resistance. As in other embodiments, it consists of a substrate 1 with a resistive element consisting of a number of resistor segments 333 connected in a series string with a plurality of pads 224 along both sides of the substrate. Also shown is a layer of protective material 4 which covers all of the resistor segments and also part of the pads. Slots 2 are provided for engaging a sprocket wheel as before.

In the embodiment of FIG. 16 a number of consecutive pads along one edge 227 will be connected together during assembly to make one connection to an external lead of the completed resistor, while a similar number of consecutive pads on the opposite edge 237 will be connected together to connect to the other external lead of the resistor. In this manner the resistor segments will be converted from a series string to a parallel string.

It is necessary to determine how many resistor segments 333 to connect in parallel. This can be done in several ways. First, the starting point must be identified. Preferably, this is done by periodically omitting a resistor segment 330 during formation of the resistor segments on the substrate tape. Measurement is preferably done by connecting a force and sense probe to pad 224 and another force and sense probe to pad 232. In this manner a four terminal resistance measurement is made possible, as before, the absence of significant resistance between adjacent force and sense probes presenting no problem. The resistance between these two pads is that of one resistor segment 333. The reciprocal of this value of resistance in ohms is determined to arrive at the conductance in omhs and that conductance is stored in the computers' memory.

Those probes contacting pad 224 are now moved to pad 234 and a measurement of the resistance between pads 232 and 234 is made, its conductance being added to that conductance already stored in memory. This process of measuring each individual resistor segment and adding its correspondng value of conductance to that in memory continues with the probes contacting pad 232 being moved to 240, etc. When the total of all conductances equals the target conductance (within acceptable limits), measurement is complete and the correct number of resistor segments 333 to be connected during assembly has been determined. These segments alone must be connected in parallel.

In the computer flow chart of FIG. 4, the probes are first placed on pads 224 and 232 (block 700), blocks 701, 702 and 717 are omitted (there being little concern for a necked down resistor segment when connected in parallel) and the computer goes directly to block 703 where the limits are those of the finished resistor. The first several measurements normally are of higher resistance or lower conductance than the target value. This then involves iterations of blocks 703 and 705, the conductance of each measurement being added to the previous accumulation and stored in the computer memory (block 705). Block 705 is modified so that, if the accumulated conductance is too low, the probes are moved so that the next measurement will be of the next resistor segment 333. Eventually the total conductance is within the necessary limits (block 703) and the location of the last segment 333 is recorded on a computer tape together with the identity of that particular resistor on the substrate tape 1 (block 707). Blocks 710, 711 and 712 are bypassed and the substrate tape 1 is advanced until the next resistor is located under the probes. A block 3701 is introduced between 715 and 703 so that all probes are returned to pads 224 and 232 of the new resistor, at which time a new measurement is made.

Connection of the appropriate segments alone is preferably done by severing the tape so only the desired segments are included. Alternatively, unwanted resistor segments can be severed as indicated at 331 by a laser beam or other means. This then makes it possible to cut the tape to a predetermined length. The use of a laser does not in this instance affect the stability of the resulting resistor as the severed resistor segments conduct no current.

A procedure which reduces the number of measurements is to assume that all resistor segments are of equal resistance. In such a case, where n is the number of segments, and
r is the resistance of one segment, then
R(series) is equal to nr, and
R(parallel) is equal to r/n, so that
R(parallel) is equal to R(series)/$n^2$.

Thus, knowing n which is determined by the physical position of the probes, and knowing R(series) from measurement, the parallel resistance can be calculated. The accuracy of this method is dependent on the consistency of resistance from one segment to another, as well as the number of such segments. In most practical situations, it will be sufficiently accurate.

Many other embodiments are possible. For example, the first pads 224 and 232 could be designed to be longer, thereby connecting a number of resistor segments 333 in parallel. In such a case sufficient segments would be connected in parallel initially so that the initial resistance measurement (between said pads 224 and 232) would be only slightly higher than the target value and the number of measurements required would be greatly reduced. For another example, a longer first set of pads 224 and 232 could be connected by a single resistive path rather than separate segments 333, thus reducing the length of tape required for a given conductance.

FIGS. 17, 18—ASSEMBLY

Figure 17:
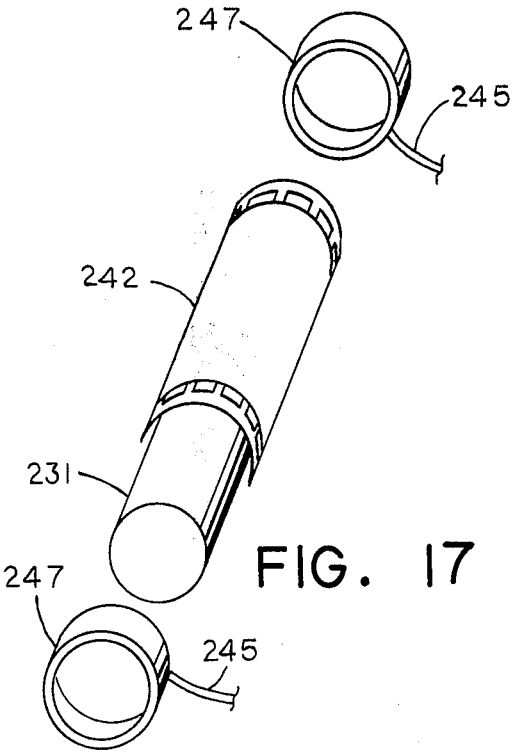
FIG. 17 shows the low-valued resistance of FIG. 16 ready for assembly.
Figure 18:
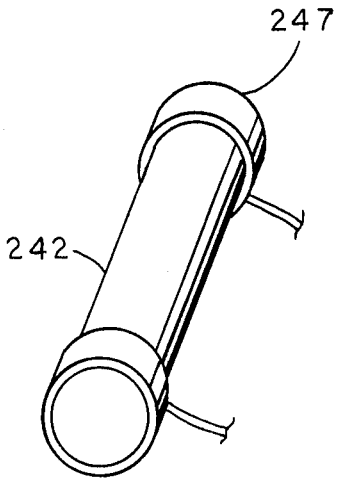
FIG. 18 shows the low-valued resistance of FIG. 16 after assembly.

A typical assembly is shown in FIGS. 17 and 18. Resistor tape 242, after being cut to length, is wrapped around a cylindrical core 231 whose circumference is greater than the length of tape 242. Two metal rings 247 with inner coatings of solder are slipped far enough over the ends of the resistor tape so as to cover the exposed part of the pads. The solder is bonded to each pad by a reflow operation. FIG. 18 shows resulting resistor which thereafter may be molded or otherwise packaged. Four terminal connections are provided where desired by the addition of two sensing leads 245 which, preferably are attached to the rings 247 prior to the assembly of the resistor.

FIG. 19—LOW TCR EMBODIMENT

In this embodiment, a resistor whose value is extremely insensitive to temperature variations is provided. This insensitivity is achieved by connecting two resistors in series with the conditions arranged such that their values change in opposite directions as temperature changes, thus giving a total resistance whose value remains substantially constant.

This embodiment uses the geometry of either FIGS. 10 or 11. However, resistor elements 172 and 174 are made of different materials and the common connection between these elements (117) is not connected to an external lead.

Figure 19:
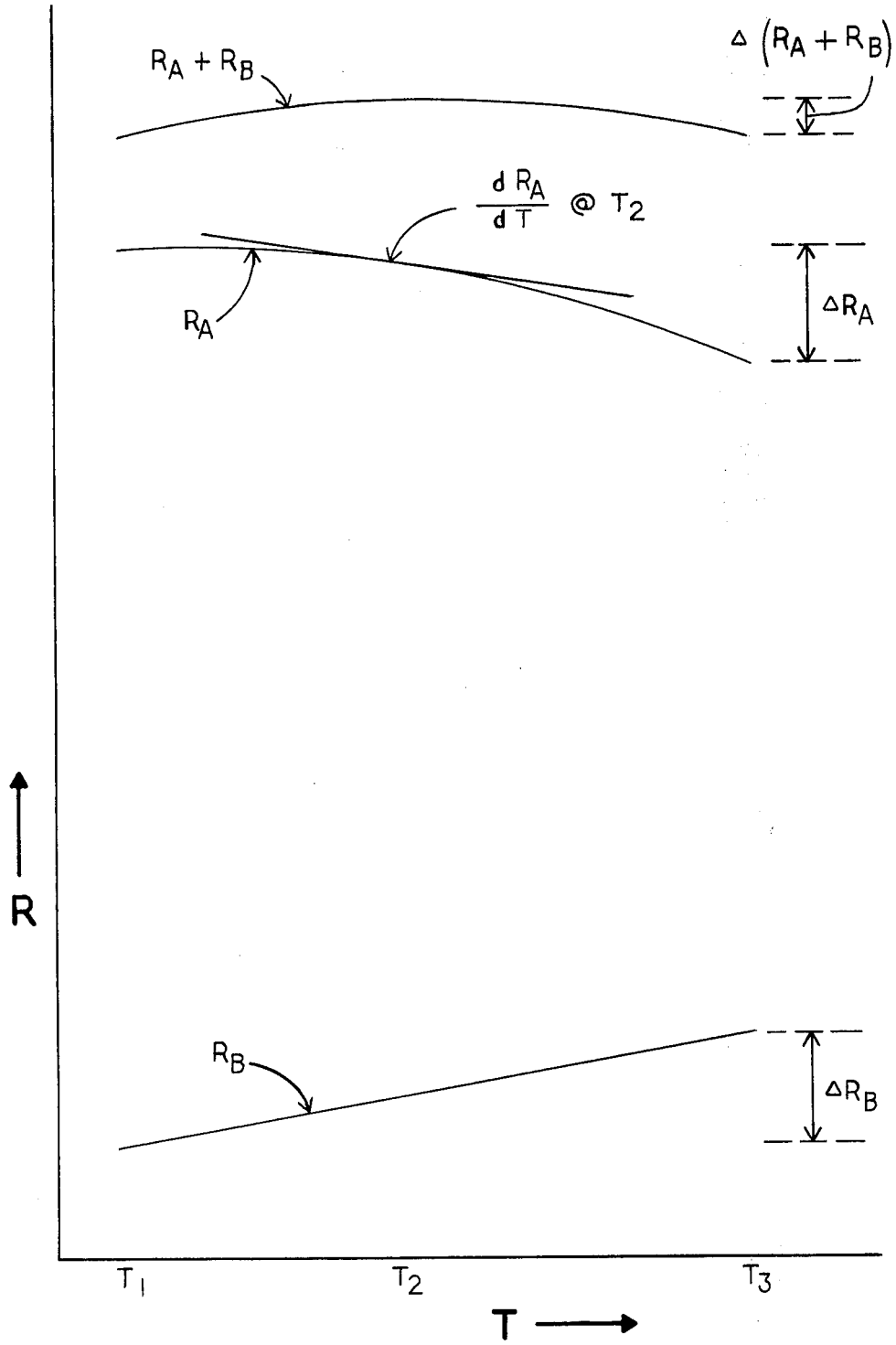
FIG. 19 shows how the temperature characteristics of two resistors combine to form a single improved characteristic.

Many resistance materials, such as Nichrome metal (an alloy consisting of approximately 80% nickel and 20% chromium, with traces of other elements sometimes added) and Manganin metal (an alloy of copper, manganese, and nickel) exhibit a parabolic type resistance characteristic as temperature changes (line $R_A$ in FIG. 19). Other materials such as copper, aluminum and most other metals exhibit a nearly linear increase in resistance with temperature (line $R_B$ in FIG. 19). The sum of resistance $R_A$ and $R_B$ (line $R_A+R_B$) is far more constant than either $R_A$ or $R_B$.

The temperature behavior of a resistor is generally described by its temperature coefficient of resistance (TCR) which is defined by the equation:

$$TCR = \frac{1}{R} \cdot \frac{dR}{dT}$$

It can be seen that this is the normalized slope of the resistance-temperature curve and, in general, it does not remain constant with temperature. Therefore, the definition of a resistor characteristic over a large temperature range involves different TCR's over different portions of the total temperature range. For this reason the value of the TCR at room temperature is of limited use in describing the behavior over the entire temperature range.

In addition, the use of the TCR does not by itself define the specific temperatures at which measurements must be made.

In this embodiment, three specific temperatures are used. Representative samples of both types of resistive materials are measured at all three temperatures while the actual production of resistors involves measurement at only one temperature. $T_1$ is a temperature below room temperature, $T_2$ is room temperature (commonly taken to be 25° C.), and $T_3$ is a temperature above room temperature. $T_1$ and $T_3$ may but do not necessarily coincide with the minimum and maximum temperatures at which the resistor characteristics are specified.

While the foregoing describes the general case, in specific cases it may be preferable to make the measurements at temperatures at or above room temperature (or at or below room temperature), depending on the desired operating temperature range.

Ideally the resistance would be the same at all temperatures. Lacking this, it is desirable that the resistance be the same at low and high temperatures such as $T_1$ and $T_3$. Mathematically this may be expressed as:

$$R_{AT_1} + R_{BT_1} = R_T$$

and $$R_{AT_3} + R_{BT_3} = R_T$$

where $$R_{AT_1}$$

is the resistance of $R_A$ at temperature $T_1$, $$R_{BT_1}$$

is the resistance of $R_B$ at temperature $T_1$, $$R_{AT_3}$$

is the resistance of $R_A$ at temperature $T_3$, $$R_{BT_3}$$

is the resistance of $R_B$ at temperature $T_3$, $R_A$ and $R_B$ are two resistors connected in series, and $R_T$ is the desired resistance.

From this it can be shown that:

$$\frac{R_{AT_1}}{R_{BT_1}} = -\frac{K_2}{K_1}$$

where $$K_1 = \frac{R_{AT_3} - R_{AT_1}}{R_{AT_1}}$$

and $$K_2 = \frac{R_{BT_3} - R_{BT_1}}{R_{BT_1}}$$

It should be noted that $K_1$ and $K_2$ are ratios. Therefore they can be determined from measurements made on any resistors made of the same materials as $R_A$ and $R_B$; knowledge of $$R_{AT_1} \text{ and } R_{BT_1}$$

is not required.

It should also be noted that $K_1$ and $K_2$ must be of opposite signs; otherwise the impractical condition that one resistor must have a negative resistance will exist.

From the above equations it can also be shown that:

$$R_{AT_1} = \left(\frac{-K_2/K_1}{1 - K_2/K_1}\right) R_T$$

and $$R_{BT_1} = \left(\frac{-K_1/K_2}{1 - K_1/K_2}\right) R_T$$

Since $R_T$ is specified in advance and since $K_1$ $K_2$ can be found from measurements of the resistance materials, the values $$R_{AT_1} \text{ and } R_{BT_1}$$

are known from simple calculations. It is possible to proceed with production of the resistors using the above values as target values. However, such production would have to be performed at temperature $T_1$. It would be far more convenient to operate at room temperature ($T_2$). In order to do so, the values $$R_{AT_2} \text{ and } R_{BT_2}$$

must be determined.

In order to establish these resistance values, the following constants are defined:

$$K_3 = \frac{R_{AT_2} - R_{AT_1}}{R_{AT_1}}$$

and $$K_4 = \frac{R_{BT_2} - R_{BT_1}}{R_{BT_1}}$$

As before, these constants can be determined by measurements of any two resistors of the same materials as $R_A$ and $R_B$, as they are ratios.

From the preceding equations it can be shown that:

$$R_{AT_2} = (1 + K_3)\left(\frac{-K_2/K_1}{1 - K_2/K_1}\right) R_T$$

and $$R_{BT_2} = (1 + K_4)\left(\frac{-K_1/K_2}{1 - K_1/K_2}\right) R_T$$

As an example, assume a resistor $R_A$ where $$R_{AT_1} = 1000\Omega$$

$$R_{AT_2} = 999\Omega$$

$$R_{AT_3} = 990\Omega$$

and a resistor $R_B$ where $$R_{BT_1} = 10\Omega$$

$$R_{BT_2} = 15\Omega$$

$$R_{BT_3} = 20\Omega$$

Then, $$K_1 = \frac{990 - 1000}{1000} = -0.01$$

$$K_2 = \frac{20 - 10}{10} = 1$$

$$K_3 = \frac{999 - 1000}{1000} = -0.001$$

and $$K_4 = \frac{15 - 10}{10} = 0.5$$

so that $$R_{AT_2} = (1 - .001)\left(\frac{-1/-.01}{1 - 1/-.01}\right) R_T$$

$$= 0.989109\ R_T$$

and $$R_{BT_2} = (1 + 0.5)\left(\frac{.01/1}{1 + .01/1}\right) R_T$$

$$= 0.014851\ R_T$$

Thus, if $$R_T = 100{,}000\Omega$$

then $$R_{AT_2} = 98{,}911\Omega$$

and $$R_{BT_2} = 1485\Omega,$$

for a total resistance of 100,396 ohms at room temperature ($T_2$).

At temperature $T_1$, $$R_{AT_1} = \frac{R_{AT_2}}{1 + K_3} = 99010\Omega$$

and $$R_{BT_1} = \frac{R_{BT_2}}{1 + K_4} = 990\Omega$$

so $$R_{AT_1} + R_{BT_1} = 99010 + 990 = 100{,}000\Omega$$

If desired, $$R_{AT_2} \text{ and } R_{BT_2}$$

may be set equal to $R_T$. This may be done by simply multiplying $$R_{AT_2} \text{ and } R_{BT_2} \text{ by } \frac{100{,}000}{100{,}396}$$

or 0.996056.

$$R_{AT_2}$$

is then 98911×0.996056 or 98521 ohms, and $$R_{BT_2}$$

is 1485×0.996056 or 1479 ohms, for a total of precisely 100,000 ohms.

Yet another alternative is to set $R_T$ at $T_2$ to any intermediate value of resistance, as desired.

With these values, production of resistors would proceed using the procedures described in FIG. 10 and 11. Resistive element 172 could be Nichrome metal or Manganin metal, for example, while element 174 could be copper or aluminum, for example.

Yet another embodiment would utilize an external lead connected to the point (117 in FIG. 10 and 11) common to both resistors. This would permit its use as a thermistor. In this embodiment, the ratio of $R_A$ and $R_B$ would change with temperature so as to give a sensitive indication of temperature change because their values change in opposite directions.

The preceding equations which have been used to describe two resistors in series can also be used to describe two resistors in parallel. This is accomplished by simply exchanging conductance for resistance terms in the equations. Thus, in the case of FIG. 16, which shows a parallel combination of resistor segments, some of the segments can be made of a resistance material having temperature characteristics opposing those of the other resistor segments. In this way, the net resistance value of all the parallel segments can be made less dependent on temperature.

In such an embodiment, segments 333 would be made of one or the other of two resistive materials, alternating from one material to the other in proportion to the number ultimately desired. Thus, if the resistivity of the segments and their TCR's were such that about 90% of the segments should be of one material and 10% of the other, then nine consecutive segments of 333 would be made of the first material and the tenth segment would be made of the second material. Adjustment of the number of segments by laser trim or other means of severing individual segments would proceed as before except that the trimming would be programmed to leave intact some particular number of one type of segment 333 and a different particular number of the other type of segment 333. Therefore, it would be necessary for the laser to trim or not trim each individual segment 333 as the laser beam was swept in one direction.

Packaging would be indentical to that shown in FIGS. 17 and 18. In this situation, where wirebonding is not required, copper would be a preferred material for pads 224, 232, 234, etc. as it is readily solderable to rings 247. In addition, copper could serve as one of the two resistive materials if desired.

The embodiment of FIG. 16 offers a means of adjusting the TCR of resistors with values below one ohm. There is no prior art which makes this possible, to the best of my knowledge.

The same concept of connecting two resistors in parallel could also be used in the embodiments of FIG. 10 and 11. In these embodiments, the pads 152, 154, 206, 306, etc. would preferably be made of aluminum for ease of wirebonding. However, in the event that areas 124 (FIG. 7) were included for purposes of external lead attachment, part of areas 124 could be plated with copper to facilitate lead attachment by soldering, for example. In such a case, the common area 117 would be used for one external lead while the other ends of elements 174 and 172 would be joined for the other external lead.

SUMMARY

Thus it is seen that precise values of resistance may be attained by providing a means of selecting a resistance value to a first approximate value and a means of adjusting the first approximate value to a second and more accurate approximate value by using much smaller increments of resistance, with all of the advantages inherent in an automated operation. The problems of making a wirewound resistor, i.e., winding wire and finding the precise point of termination, are eliminated. The provision of a long resistive path permits the use of films of sufficient thickness to avoid the problems inherent in thin films. The problems associated with trimming, whether by laser or mechanical abrasion, or by severing shorting elements, are eliminated. The present invention involves creation of resistors with low material and production costs, measured and assembled using techniques which permit selection of a value of resistance to a predetermined magnitude and accuracy, using material whose great stability is not compromised by the process of measurement, adjustment or assembly, with all of the above accomplished with a high degree of automation. The result is the ability to produce resistors of the highest accuracy and stability at a fraction of the cost currently incurred. In addition, the ease of using a large number of resistive segments facilitates the process of producing very high and very low resistance values, by using series or parallel configurations. In addition, the ability to combine resistors with opposing temperature characteristics offers a means of substantially reducing temperature variations of resistance.

Whie the above discussion contains many specificities, these should not be construed as limitations on the scope of the invention, but rather as exemplifications of several preferred embodiments. Many other possibilities will be envisioned by those skilled in the art. For example, a substrate 1 of other than polyimide is possible, Mylar and fluorocarbon resin being but two possibilities. Capacitor fabrication techniques can be utilized; the use of a metal/metal-oxide substrate such as aluminum/aluminum-oxide could offer possible advantages. The substrate need not be flexible as a rigid substrate would be advantageous in specific situations. All dimensions and number of resistive segments, pads, etc., can vary greatly from the exemplary values given, as can the geometries. The resistor film is not limited to Nichrome metal with or without trace elements, Manganin metal, or tantalum; other materials such as tin oxide, carbon, tantalum nitride or any other resistive materials can be used for resistive patterns, as can such normal "conductors" as aluminum or copper. Attachment to pads such as 102 need not be limited to thermocompression or ultrasonic wirebonding; other embodiments with pads large enough to accommodate such bonding techniques as soldered wires can be devised by those skilled in the art. The structures are not limited to single or tapped resistors. Complex networks involving a number of resistors with geometries designed so as to assure uniform changes with temperature variation can be envisioned by those skilled in the art. It is not necessary for pads to be of uniform spacing nor for force and sense probes to contact separate pads, for example. Packaging is not limited to the few examples shown; bonding the tape to a flat surface offers advantages of improved power dissipation, and the creation of a distributed capacitance from the resistor pattern to ground by such assembly can provide a distributed RC filter structure. The technique of component value determination according to the invention can also be used for fabrication of other components, such as capacitors, inductors, etc. The term "resistance", when used in the claims, shall be interpreted to include its reciprocal, conductance. These few examples suggest the great variety of embodiments which are made possible by this invention. Therefore the true scope of this invention should be determined only by the appended claims and their legal equivalents.

What is claimed is:

1. A method of fabricating a resistor having a predetermined value of resistance within a precisely-predetermined tolerance range, comprising the following steps:

(a) providing an elongated resistive element having a plurality of contact pads thereon, said pads having predetermined spacings along said element so as to divide said element into resistive segments, said resistive element constituting a first layer of resistive material, the portions of said first layer which constitute said control pads being covered by a second layer, said second layer being of a material which is different from that of said first layer and which is capable of being bonded to a connecting wire, said segments each having a resistance value which is less than said tolerance range, (b) measuring the resistance of a known number of segments from 1 to m, where m is a whole number, of said resistive segments, (c) calculating the number of said resistive segments necessary to attain said predetermined value of resistance, within a tolerance range equal to the value of resistance of one of said resistive segments, using as a basis the measured resistance of said known number of resistive segments, (d) indentifying a pair of said contact pads which are connected across said claculated number of resistive segments, and (e) connecting conductors to the pads so identified.

2. The method of claim 1 wherein said measuring, combining, and identifying steps are performed by automated electromechanical means.

3. The method of claim 1 wherein said elongated resistive element is provided with two sets of taps thereon, a first set having a relatively large resistance between adjacent taps, and a second set having a relatively small resistance between adjacent taps, and said combining step is performed in two stages: the first stage comprising the combination of the resistance of resistive segments between said first set of taps until a rough approximation of said predetermined total resistance within the range of one of said segments within said first set of taps is attained, and the second comprising the combination of the resistance of resistive segments between said second set of taps until a precise approximation of said predetermined total within the range of one of said segments within said second set of taps is attained.

4. The method of claim 3 wherein a third set of taps is added with the resistance between said third taps being small relative to the resistance between the second set of taps so as to permit a yet more precise adjustment of the resistance.

5. The method of claim 3 wherein said measuring, combining, and identifying steps are performed by automated electromechanical means.

6. The method of claim 1 wherein said elongated resistive element if provided on a flexible, nonconductive substrate.

7. The method of claim 6 wherein substrate is rolled into a scroll to have a cylindrical shape.

8. The method of claim 1 wherein said elongated resistive element is provided on a flexible, nonconductive substrate and a second resistor is formed by replicating said steps B, C, and D at a second part of said resistive element adjacent the first formed resistor, and conductors are attached to the tap identified for said first and second resistors and a tap common to said first and second resistors, whereby a precision voltage divider is formed.

9. The method of claim 8 wherein said elongated resistive element is rolled from both ends thereof to form a double scroll having a torah shape.

10. The method of claim 8 wherein said second part of said resistive element is positioned generally parallel to the first part of said resistive element from which said first-formed resistor is constructed, whereby both portions of said voltage divider will experience substantially identical temperature variations and thereby change resistances in a manner which will not change the resistance ratio of said voltage divider.

11. The method of claim 1 wherein said elongated resistive element is provided on a nonconductive substrate and a second resistor is formed by replicating said steps B, C, and D at a second part of said resistive element having a temperature versus resistance variation, for a predetermined temperature range, which is generally opposite to that of the first part of said resistive element, such that when said first and second parts of said resistive elements are connected in series, the total resistance of said element will remain substantially constant throughout said temperature range.

12. The method of claim 11 further including connecting a separate external lead to the point common to the two resistive elements, thereby to provide a tapped resistor in which the ratio of the resistance from one end of either of said two resistive elements to said separate external lead to the total resistance of said two resistive elements is proportional to ambient temperature.

13. The method of claim 11 further including connecting said resistive elements in parallel.

14. The method of claim 1 wherein the resistive segments across which said pair of identified pads are connected includes said first-measured, known number of segments.

15. The method of claim 14 wherein the number of resistive segments is calculated by an additive process using segment resistance values and all of said segments are left connected in series to attain said predetermined value of resistance.

16. The method of claim 14 wherein the number of resistive segments is calculated by an additive process using the reciprocals of the segment resistance values and all of said segments are connected in parallel to attain said predetermined value of resistance.

17. The method of claim 14 wherein the value of resistance of said segments is calculated by a subtractive process using segment resistance values and all of said segments are left connected in series to attain said predetermined value of resistance.

18. The method of claim 14 wherein the number of resistive segments is calculated by a subtractive process using the reciprocals of segment resistive values and all of said segments are connected in parallel to attain said predetermined value of resistance.

19. A method of fabricating a resistor having a predetermined value of resistance within a precisely-predetermined tolerance range comprising the following steps:

(a) providing an elongated resistive element having first and second sets of taps thereon, said first set being positioned on a first portion of said element the resistive segments between adjacent taps of said first set having a predetermined relatively large resistance so as to divide said element into a first set of resistive segments of relatively high resistance valve, and a second set being positioned on a second portion of said element adjacent said first set of taps and the resistive segments between adjacent taps of said second set having a relatively small resistance so as to divide said element into a second set of resistive segments of relatively low resistance, said second set of resistive segments each having a resistance value less than said predetermined tolerance range, (b) measuring the resistance of a first segment of said resistive element between a first pair of taps in said first set, (c) combining the resistance of sufficient successive additional tapped resistive segments adjacent said first pair of taps so as to attain a value of resistance roughly approximating said predetermined value within the range of the resistance value between adjacent taps of said first set, but less than said predetermined value, (d) measuring the resistance between a first pair of taps in said second set, (e) combining the resistance of sufficient additional tapped resistive segments adjacent said first pair of taps in said second set with the value of resistance attained in step (c) so as to attain a value of resistance finely approximating said predetermined value within the range of the resistance value between adjacent taps of said second set.

(f) identifying the taps in said first and second sets which bound said value of resistance finely approximating said predetermined value, and (g) connecting conductors to the taps so identified.

20. The method of claim 19 wherein said resistance element has a uniform resistivity along the length thereof and said first set of taps are spaced so that adjacent taps have a relatively large spacing therebetween and said second set of taps are spaced so that adjacent taps have a relatively small spacing therebetween.

21. A method of fabricating a resistor having a predetermined value of resistance within a precisely-predetermined tolerance range, comprising the following steps:

(a) providing an elongated resistive element having a plurality of contact pads thereon, said pads having predetermined spacings along said element so as to divide said element into resistive segments, said resistive element constituting a first layer of resistive material, the portions of said first layer which constitute said pad being covered by a second layer, said second layer being of a material which is different from said first layer and which is capable of being bonded to a connecting wire, said segments each having a resistance value which is less than said tolerance range, (b) contacting a pair of conductive probes respectively to a first of said pads and a second of said pads separated from said first pad by a predetermined spacing and a whole number of said resistive segments, (c) supplying a current through said resistive segments between said first and second pads via said conductive probes, (d) measuring the resistance of said resistive segments between said first and second pads by a calculation using the values of current flowing through and voltage across said resistive segments, (e) comparing the measured resistance of said segments with said predetermined value of resistance and (1) identifying said first and second pads if said measured resistance is within a given tolerance range of said predetermined value of resistance, or (2) moving said second probe to a pad different from said first and second pads if said measured resistance is outside said given tolerance range of said predetermined value of resistance, and repeating said steps (c) and (d) with said first pad and said different pad if the measured resistance therebetween is within said given tolerance range of said predetermined value of resistance, and (f) attaching connectors to the last pads identified.

22. The method of claim 21 wherein said moving of said second probe is performed by moving said second probe to sequentially adjacent pads from said second pad and measuring the resistance from said first pad to each such sequentially adjacent pad until such measured resistance is within said tolerance range of said predetermined value of resistance.

23. The method of claim 21 wherein said moving of said second probe is performed by calculating the number of sufficient resistive segments adjacent to said resistive segments between said first and second pads, based upon the measured value of resistance between said first and second pads and the number of resistive segments therebetween, to attain a total value of resistance substantially at least as close to the value of one of said resistive segments to said predetermined value of resistance.

24. The method of claim 21 wherein said contacting, current supplying, measuring, and comparing steps are performed by automated electromechanical means.

25. The method of claim 21 wherein said elongated resistive element is translatable and further including the step of translating said elongated resistive element, after said first pad and said different pad, so that a different set of resistive elements than those between said last pads identified is adjacent said probes.

26. The method of claim 25 wherein said elongated resistive element is provided on a tape carrier and said translating step comprises conveying said carrier from one reel to another.

27. The method of claim 21 wherein said step of moving said second probe is performed by moving said second probe farther away from said first pad if said measured resistance is below said predetermined value and outside said tolerance range therefrom, and closer to said first pad if said measured resistance is above said predetermined value and outside said tolerance range therefrom.

28. A method of fabricating a resistor having a predetermined value of resistance which is extremely insensitive to temperature variations, comprising:

(a) providing a pair of resistors in a common physical association such that both resistors of said pair will experience similar temperature changes in response to ambient temperature variations or self-induced heating, said resistors having temperature coefficients of resistivity of opposite signs, said resistors each including means for making an adjustment of its value of resistance within a predetermined range.

(b) determining the temperature coefficient of resistivity of each of said resistors after said resistors are provided in said common physical association, (c) using said determined temperature coefficients of resistivity, computing a pair of values of resistances of said pair of resistors such that when said resistance values of resistance are combined in a predetermined manner, said predetermined value of resistance will be attained, and any temperature induced increase in the value of one of said resistors will be offset by a corresponding decrease in the value of the other of said resistors, and (d) adjusting the value of resistance of at least one of said resistors is that said resistors, when combined in said predetermined manner, will have said computed pair of values of resistance.

29. The method of claim 28 wherein said resistors are provided as thin films of resistive material on a common substrate, said means for adjusting comprises spaced contact pads on each resistor, and said adjusting comprises the selection of and connection to a selected pair of said pads for each resistor.

30. The method of claim 29 wherein said common substrate is flexible and is rolled into a coil and unrolled for processing.

31. The method of claim 28 wherein said resistors are connected together at a common connection.

32. The method of claim 31 further including the step of connecting a conductive member to said common connection between said resistors so as to provide a pair of resistors whose ratio provides a measurement of temperature.

33. The method of claim 31 wherein said resistors are connected in series and said computing step is performed for a series connection.

34. The method of claim 31 wherein said resistors are connected in parallel and said computing step is performed for a parallel connection.

35. The method of claim 28 wherein said computing step is performed by

A. measuring the resistance of each of said pair of resistors at one predetermined temperature and recording their respective resistances, B. measuring the resistance of said pair of resistors at a second predetermined temperature and recording their respective resistances, C. based upon the resistances obtained from steps A and B, calculating a pair of values to which said pair of resistors must be adjusted so that (1) the sum of their resistances is equal to said predetermined value of resistance, and (2) the shifts in their resistances over a predetermined temperature range will be in opposite directions, but the sum of their resistances will still be equal to said predetermined value of resistance, and, D. adjusting the two resistors to said pair of values.

36. The method of claim 35 where said calculating step is performed based upon a parallel combination of said pair of resistors.

* * * * *